US007862151B2

(12) United States Patent
McAvoy et al.

(10) Patent No.: US 7,862,151 B2
(45) **Date of Patent: *Jan. 4, 2011**

(54) PRINTHEAD WITH DROPLET REDIRECTING NOZZLE GUARD

(75) Inventors: Gregory John McAvoy, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 243 days.

This patent is subject to a terminal disclaimer.

(21) Appl. No.: 12/246,354

(22) Filed: Oct. 6, 2008

(65) Prior Publication Data

US 2009/0046126 A1 Feb. 19, 2009

Related U.S. Application Data

(63) Continuation of application No. 11/357,297, filed on Feb. 21, 2006, now Pat. No. 7,461,921.

(51) Int. Cl.
*B41J 2/14* (2006.01)
*B41J 2/16* (2006.01)

(52) U.S. Cl. ..... 347/47; 347/54

(58) Field of Classification Search ..... 347/20, 347/40, 42, 44, 45, 47, 54, 56, 62–65, 67
See application file for complete search history.

(56) References Cited

U.S. PATENT DOCUMENTS

| | | | | |
|---|---|---|---|---|
| 5,208,606 | A | 5/1993 | Klein et al. | |
| 6,217,155 | B1 | 4/2001 | Silverbrook | |
| 6,357,857 | B1 | 3/2002 | Takemoto et al. | |
| 7,461,921 | B2 * | 12/2008 | McAvoy et al. | 347/47 |
| 2003/0081063 | A1 | 5/2003 | Stanton et al. | |
| 2003/0197762 | A1 | 10/2003 | Park et al. | |
| 2005/0162469 | A1 | 7/2005 | Min et al. | |

FOREIGN PATENT DOCUMENTS

| | | | |
|---|---|---|---|
| DE | 4207626 | A1 | 9/1993 |
| EP | 0479493 | A1 | 4/1992 |
| JP | 10-337874 | A | 12/1998 |

* cited by examiner

*Primary Examiner*—Juanita D Stephens

(57) ABSTRACT

A printhead is provided having an ejection surface having a plurality of nozzles for ejecting droplets and a nozzle guard positioned over the ejection surface and having a plurality of channels therethrough aligned with the nozzles. The channels have hydrophobic sidewalls and are radially flared with respect to the ink ejection surface such that droplets which are ejected from the nozzles with misdirection rebound off the channel sidewalls to pass through the channels.

10 Claims, 17 Drawing Sheets

PRINTHEAD WITH DROPLET REDIRECTING NOZZLE GUARD

CROSS REFERENCE TO RELATED APPLICATION

This application is a continuation application of U.S. patent application Ser. No. 11/357,297 filed on Feb. 21, 2006, now issued U.S. Pat. No. 7,461,921, herein incorporated by reference.

FIELD OF THE INVENTION

This invention relates to a printhead assembly suitable for redirecting ink droplets ejected from a printhead. It has been developed primarily to improve overall print quality and to provide robust protection of nozzle structures on the printhead.

CO-PENDING APPLICATIONS

The following applications have been filed by the Applicant simultaneously with U.S. Pat. No. 7,461,921:

| | |
|---|---|
| 7,416,283 | 7,438,386 |

The disclosures of these co-pending applications are incorporated herein by reference.

CROSS REFERENCES TO RELATED APPLICATIONS

The following patents or patent applications filed by the applicant or assignee of the present invention are hereby incorporated by cross-reference.

| | | | | | |
|---|---|---|---|---|---|
| 6,750,901 | 6,476,863 | 6,788,336 | 7,249,108 | 6,566,858 | 6,331,946 |
| 6,246,970 | 6,442,525 | 7,346,586 | 7,685,423 | 6,374,354 | 7,246,098 |
| 6,816,968 | 6,757,832 | 6,334,190 | 6,745,331 | 7,249,109 | 7,197,642 |
| 7,093,139 | 7,509,292 | 7,685,424 | 7,743,262 | 7,210,038 | 7,401,223 |
| 7,702,926 | 7,716,098 | 7,364,256 | 7,258,417 | 7,293,853 | 7,328,968 |
| 7,270,395 | 7,461,916 | 7,510,264 | 7,334,864 | 7,255,419 | 7,284,819 |
| 7,229,148 | 7,258,416 | 7,273,263 | 7,270,393 | 6,984,017 | 7,347,526 |
| 7,357,477 | 7,465,015 | 7,364,255 | 7,357,476 | 7,758,148 | 7,284,820 |
| 7,341,328 | 7,246,875 | 7,322,669 | 7,445,311 | 7,452,052 | 7,455,383 |
| 7,448,724 | 7,441,864 | 7,331,651 | 7,334,870 | 7,334,875 | 7,506,958 |
| 7,472,981 | 7,448,722 | 7,575,297 | 7,438,381 | 7,441,863 | 7,438,382 |
| 7,425,051 | 7,399,057 | 7,695,097 | 7,686,419 | 7,753,472 | 7,448,720 |
| 7,448,723 | 7,445,310 | 7,399,054 | 7,425,049 | 7,367,648 | 7,370,936 |
| 7,401,886 | 7,506,952 | 7,401,887 | 7,384,119 | 7,401,888 | 7,387,358 |
| 7,413,281 | 6,623,101 | 6,406,129 | 6,505,916 | 6,457,809 | 6,550,895 |
| 6,457,812 | 7,152,962 | 6,428,133 | 7,571,541 | 7,736,458 | 11/305,275 |
| 7,776,175 | 7,416,629 | 7,469,987 | 7,204,941 | 7,282,164 | 7,465,342 |
| 7,278,727 | 7,417,141 | 7,452,989 | 7,367,665 | 7,138,391 | 7,153,956 |
| 7,423,145 | 7,456,277 | 7,550,585 | 7,122,076 | 7,148,345 | 7,470,315 |
| 7,572,327 | 7,416,280 | 7,252,366 | 7,488,051 | 7,360,865 | 6,746,105 |
| 7,744,195 | 7,645,026 | 7,322,681 | 7,708,387 | 7,753,496 | 7,712,884 |
| 7,510,267 | 7,465,041 | 11/246,712 | 7,465,032 | 7,401,890 | 7,401,910 |
| 7,470,010 | 7,735,971 | 7,431,432 | 7,465,037 | 7,445,317 | 7,549,735 |
| 7,597,425 | 7,661,800 | 7,712,869 | 7,156,508 | 7,159,972 | 7,083,271 |
| 7,165,834 | 7,080,894 | 7,201,469 | 7,090,336 | 7,156,489 | 7,413,283 |
| 7,438,385 | 7,083,257 | 7,258,422 | 7,255,423 | 7,219,980 | 7,591,533 |
| 7,416,274 | 7,367,649 | 7,118,192 | 7,618,121 | 7,322,672 | 7,077,505 |
| 7,198,354 | 7,077,504 | 7,614,724 | 7,198,355 | 7,401,894 | 7,322,676 |
| 7,152,959 | 7,213,906 | 7,178,901 | 7,222,938 | 7,108,353 | 7,104,629 |
| 7,303,930 | 7,401,405 | 7,464,466 | 7,464,465 | 7,246,886 | 7,128,400 |
| 7,108,355 | 6,991,322 | 7,287,836 | 7,118,197 | 7,575,298 | 7,364,269 |
| 7,077,493 | 6,962,402 | 7,686,429 | 7,147,308 | 7,524,034 | 7,118,198 |
| 7,168,790 | 7,172,270 | 7,229,155 | 6,830,318 | 7,195,342 | 7,175,261 |

-continued

| | | | | | |
|---|---|---|---|---|---|
| 7,465,035 | 7,108,356 | 7,118,202 | 7,510,269 | 7,134,744 | 7,510,270 |
| 7,134,743 | 7,182,439 | 7,210,768 | 7,465,056 | 7,134,745 | 7,156,484 |
| 7,118,201 | 7,111,926 | 7,431,433 | 7,018,021 | 7,401,901 | 7,468,139 |
| 7,128,402 | 7,387,369 | 7,484,832 | 7,448,729 | 7,246,876 | 7,431,431 |
| 7,419,249 | 7,377,623 | 7,328,978 | 7,334,876 | 7,147,306 | 7,721,948 |
| 7,079,712 | 6,825,945 | 7,330,974 | 6,813,039 | 6,987,506 | 7,038,797 |
| 6,980,318 | 6,816,274 | 7,102,772 | 7,350,236 | 6,681,045 | 6,728,000 |
| 7,173,722 | 7,088,459 | 7,707,082 | 7,068,382 | 7,062,651 | 6,789,194 |
| 6,789,191 | 6,644,642 | 6,502,614 | 6,622,999 | 6,669,385 | 6,549,935 |
| 6,987,573 | 6,727,996 | 6,591,884 | 6,439,706 | 6,760,119 | 7,295,332 |
| 6,290,349 | 6,428,155 | 6,785,016 | 6,870,966 | 6,822,639 | 6,737,591 |
| 7,055,739 | 7,233,320 | 6,850,196 | 6,832,717 | 6,957,768 | 7,456,820 |
| 7,170,499 | 7,106,888 | 7,123,239 | 10/727,162 | 7,377,608 | 7,399,043 |
| 7,121,639 | 7,165,824 | 7,152,942 | 10/727,157 | 7,181,572 | 7,096,137 |
| 7,302,592 | 7,278,034 | 7,188,282 | 7,592,829 | 10/727,179 | 10/727,192 |
| 7,770,008 | 7,707,621 | 7,523,111 | 7,573,301 | 7,660,998 | 7,783,886 |
| 10/54,938 | 10/727,160 | 7,171,323 | 7,278,697 | 7,369,270 | 6,795,215 |
| 7,070,098 | 7,154,638 | 6,805,419 | 6,859,289 | 6,977,751 | 6,398,332 |
| 6,394,573 | 6,622,923 | 6,747,760 | 6,921,144 | 7,092,112 | 7,192,106 |
| 7,457,001 | 7,173,739 | 6,986,560 | 7,008,033 | 7,551,324 | 7,222,780 |
| 7,270,391 | 7,150,510 | 7,195,328 | 7,182,422 | 7,374,266 | 7,427,117 |
| 7,448,707 | 7,281,330 | 10/854,503 | 7,328,956 | 7,735,944 | 7,188,928 |
| 7,093,989 | 7,377,609 | 7,600,843 | 10/854,498 | 7,390,071 | 10/854,526 |
| 7,549,715 | 7,252,353 | 7,607,757 | 7,267,417 | 10/854,505 | 7,517,036 |
| 7,275,805 | 7,314,261 | 7,281,777 | 7,290,852 | 7,484,831 | 7,758,143 |
| 10/854,527 | 7,549,718 | 10/854,520 | 7,631,190 | 7,557,941 | 7,757,086 |
| 10/854,501 | 7,266,661 | 7,243,193 | 10/854,518 | 7,163,345 | 7,465,033 |
| 7,452,055 | 7,470,002 | 7,722,161 | 7,475,963 | 7,448,735 | 7,465,042 |
| 7,448,739 | 7,438,399 | 11/293,794 | 7,467,853 | 7,461,922 | 7,465,020 |
| 7,722,185 | 7,461,910 | 7,270,494 | 7,632,032 | 7,475,961 | 7,547,088 |
| 7,611,239 | 7,735,955 | 7,758,038 | 7,681,876 | 7,780,161 | 7,448,734 |
| 7,425,050 | 7,364,263 | 7,201,468 | 7,360,868 | 7,234,802 | 7,303,255 |
| 7,287,846 | 7,156,511 | 10/760,264 | 7,258,432 | 7,097,291 | 7,645,025 |
| 10/760,248 | 7,083,273 | 7,367,647 | 7,374,355 | 7,441,880 | 7,547,092 |
| 10/760,206 | 7,513,598 | 10/760,270 | 7,198,352 | 7,364,264 | 7,303,251 |
| 7,201,470 | 7,121,655 | 7,293,861 | 7,232,208 | 7,328,985 | 73,442,327 |
| 7,083,272 | 7,621,620 | 7,669,961 | 7,331,663 | 7,360,861 | 7,328,973 |
| 7,427,121 | 7,407,262 | 7,303,252 | 7,249,822 | 7,537,309 | 7,311,382 |
| 7,360,860 | 7,364,257 | 7,390,075 | 7,350,896 | 7,429,096 | 7,384,135 |
| 7,331,660 | 7,416,287 | 7,488,052 | 7,322,684 | 7,322,685 | 7,311,381 |
| 7,270,405 | 7,303,268 | 7,470,007 | 7,399,072 | 7,393,076 | 7,681,967 |
| 7,588,301 | 7,249,833 | 7,524,016 | 7,490,927 | 7,331,661 | 7,524,043 |
| 7,300,140 | 7,357,492 | 7,357,493 | 7,566,106 | 7,380,902 | 7,284,816 |
| 7,284,845 | 7,255,430 | 7,390,080 | 7,328,984 | 7,350,913 | 7,322,671 |
| 7,380,910 | 7,431,424 | 7,470,006 | 7,585,054 | 7,347,534 | 7,441,865 |
| 7,469,989 | 7,367,650 | 7,469,990 | 7,441,882 | 7,556,364 | 7,357,496 |
| 7,467,863 | 7,431,440 | 7,431,443 | 7,527,353 | 7,524,023 | 7,513,603 |
| 7,467,852 | 7,465,045 | | | | |

BACKGROUND OF THE INVENTION

Many different types of printing have been invented, a large number of which are presently in use. The known forms of print have a variety of methods for marking the print media with a relevant marking media. Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques on ink jet printing have been invented. For a survey of the field, reference is made to an article by J Moore, "Non-Impact Printing: Introduction and Historical Perspective", Output Hard Copy Devices, Editors R Dubeck and S Sherr, pages 207-220 (1988).

Ink Jet printers themselves come in many different types. The utilization of a continuous stream of ink in ink jet printing appears to date back to at least 1929 wherein U.S. Pat. No. 1,941,001 by Hansell discloses a simple form of continuous stream electro-static ink jet printing.

U.S. Pat. No. 3,596,275 by Sweet also discloses a process of a continuous ink jet printing including the step wherein the ink jet stream is modulated by a high frequency electro-static field so as to cause drop separation. This technique is still utilized by several manufacturers including Elmjet and Scitex (see also U.S. Pat. No. 3,373,437 by Sweet et al)

Piezoelectric ink jet printers are also one form of commonly utilized ink jet printing device. Piezoelectric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezoelectric crystal, Stemme in U.S. Pat. No. 3,747,120 (1972) discloses a bend mode of piezoelectric operation, Howkins in U.S. Pat. No. 4,459,601 discloses a piezoelectric push mode actuation of the ink jet stream and Fischbeck in U.S. Pat. No. 4,584,590 which discloses a shear mode type of piezoelectric transducer element.

Recently, thermal ink jet printing has become an extremely popular form of ink jet printing. The ink jet printing techniques include those disclosed by Endo et al in GB 2007162 (1979) and Vaught et al in U.S. Pat. No. 4,490,728. Both the aforementioned references disclosed ink jet printing techniques that rely upon the activation of an electrothermal actuator which results in the creation of a bubble in a constricted space, such as a nozzle, which thereby causes the ejection of ink from an aperture connected to the confined space onto a relevant print media. Printing devices utilizing the electro-thermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

A common problem with inkjet printers is that an unavoidable number of ink droplets ejected from each nozzle are misdirected. By "misdirected", it is meant that the ink droplet does not follow its intended trajectory towards a print medium. Usually, the intended trajectory of an ink droplet is perpendicular to an ink ejection surface of the printhead. However, some misdirected ink droplets may be ejected at a skewed angle for a variety of reasons.

In some cases, misdirected ink droplets may be a result of malformed nozzles or nozzle openings during the printhead manufacturing process. In these cases, the misdirected ink droplets will be systematic and generally unavoidable.

In other cases, misdirected ink droplets will be irregular and unpredictable. These may result from, for example, dust particles partially occluding nozzle openings, ink flooding across the surface of the printhead between adjacent nozzles, or variations in ink viscosity. Typically, an increase in ink viscosity will lead to a greater number of misdirects and ultimately result in nozzles becoming clogged—a phenomenon known in the art as "decap".

Misdirected ink droplets are clearly problematic in the inkjet printing art. Misdirected ink droplets result in reduced print quality and need to be minimized as far as possible. They are especially problematic in the high-speed inkjet printers developed by the present Applicant. When printing onto a moving print medium at speeds of up to 60 pages per minute, the effects of misdirects are magnified compared with traditional inkjet printers.

Accordingly, a number of measures are normally taken to avoid the causes of misdirects. These measures may include, for example, low manufacturing tolerances to minimize malformed nozzles, printhead designs and surface materials which minimize ink flooding, filtered air flow across the printhead to minimize build up of dust particles, and fine temperature control in the nozzles to minimize variations in ink temperature and, hence, ink viscosity.

However, all of these measures significantly add to manufacturing costs and do not necessarily prevent misdirects. Even when such measures are implemented, some misdirects are inevitable and can still result in unacceptably low print quality.

It would be desirable to provide a printhead assembly, which gives improved print quality. It would further be desirable to provide a printhead assembly, which reduces the effects (in terms of reduced print quality) of misdirected ink droplets. It would still further be desirable to provide a printhead assembly, which gives robust protection of nozzle structures formed on the surface of the printhead.

SUMMARY OF THE INVENTION

In a first aspect, there is provided a method of redirecting ejected ink droplets from a printhead, the method comprising the steps of:

(a) providing a printhead assembly comprising:

a printhead including a plurality of nozzles for ejecting ink droplets onto a print medium, the plurality of nozzles being formed on an ink ejection surface of the printhead; and a nozzle guard positioned over the ink ejection surface, the nozzle guard having a corresponding plurality of channels therethrough, the channels being aligned with the nozzles such that ejected ink droplets pass through respective channels towards the print medium; and (b) ejecting ink droplets from the nozzles, wherein the channels have hydrophobic sidewalls, such that misdirected ink droplets rebound off the sidewalls and continue through the channels towards the print medium.

In a second aspect, there is provided a nozzle guard for a printhead, said nozzle guard having a plurality of channels therethrough, each channel corresponding to a respective nozzle on the printhead such that, in use, ink droplets ejected from each nozzle pass through their respective channel towards a print medium, wherein the channels have hydrophobic sidewalls.

In a third aspect, there is provided a printhead assembly suitable for redirecting ejected ink droplets, the printhead assembly comprising:

a printhead including a plurality of nozzles for ejecting ink droplets onto a print medium, the plurality of nozzles being formed on an ink ejection surface of the printhead; and a nozzle guard positioned over the ink ejection surface, the nozzle guard having a corresponding plurality of channels therethrough, the channels being aligned with the nozzles such that ejected ink droplets pass through respective channels towards the print medium, wherein the channels have hydrophobic sidewalls.

Hitherto, and as discussed above, the problem of misdirects was addressed by various measures which minimize the number of misdirected ink droplets being ejected from each nozzle. In the present invention, there is provided a means by which misdirected ink droplets can be redirected onto a more favourable trajectory.

A number of nozzle guards for inkjet printers have been proposed in the inkjet printing art, but these have been solely for the purpose of protecting ink nozzles. Nozzle guards which function additionally as a means for redirecting misdirects have not been previously conceived.

The present invention relies on the well known phenomenon that microscopic droplets (e.g. <2.0 pL) having a high surface energy will bounce off surfaces, especially hydrophobic surfaces. Depending on the angle of incidence, the droplets will typically remain intact and experience minimal loss in velocity. It is understood by the present Applicant, from extensive studies and simulations, that this phenomenon can be used to minimize the number of misdirects during inkjet printing. With suitable hydrophobic sidewalls on the nozzle guard channels, misdirected ink droplets can be redirected onto a target print zone by rebounding off these sidewalls.

Optionally, the channel sidewalls are substantially perpendicular to the ink ejection surface of the printhead. For example, the channels may be substantially cylindrical. An advantage of this arrangement is that the channels are relatively simple to manufacture.

Optionally, the channels are radially flared with the respect to the ink ejection surface. For example, the channels may be substantially parabolic in cross-section. An advantage of this arrangement is that the curvature of the channel sidewalls redirects rebounded ink droplets in a direction substantially perpendicular to the ink ejection surface.

Optionally, each channel comprises a first portion proximal to its respective nozzle and a second portion extending away from its respective nozzle, wherein the first portion is broader in cross-section than the second portion. Optionally, the first and second portions of each channel are coaxial. This arrangement provides a capping structure over each nozzle.

Optionally, the entire nozzle guard is formed from a hydrophobic material, such as a polymer. Typically, the nozzle guard is formed from photoresist, which has been UV cured and/or hardbaked. An advantage of the nozzle guard being formed from photoresist is that it can be formed by coating a layer of photoresist onto the fabricated printhead, and defining the channels through the nozzle guard by standard exposure and development steps.

Typically, the channels have a length in the range of about 10 to 200 microns, which generally corresponds to the height of the nozzle guard.

BRIEF DESCRIPTION OF THE DRAWINGS

The invention will now be described with reference to the following drawings, in which:—

DETAILED DESCRIPTION OF SPECIFIC EMBODIMENTS OF THE INVENTION

Printhead Assembly

Figure 1:
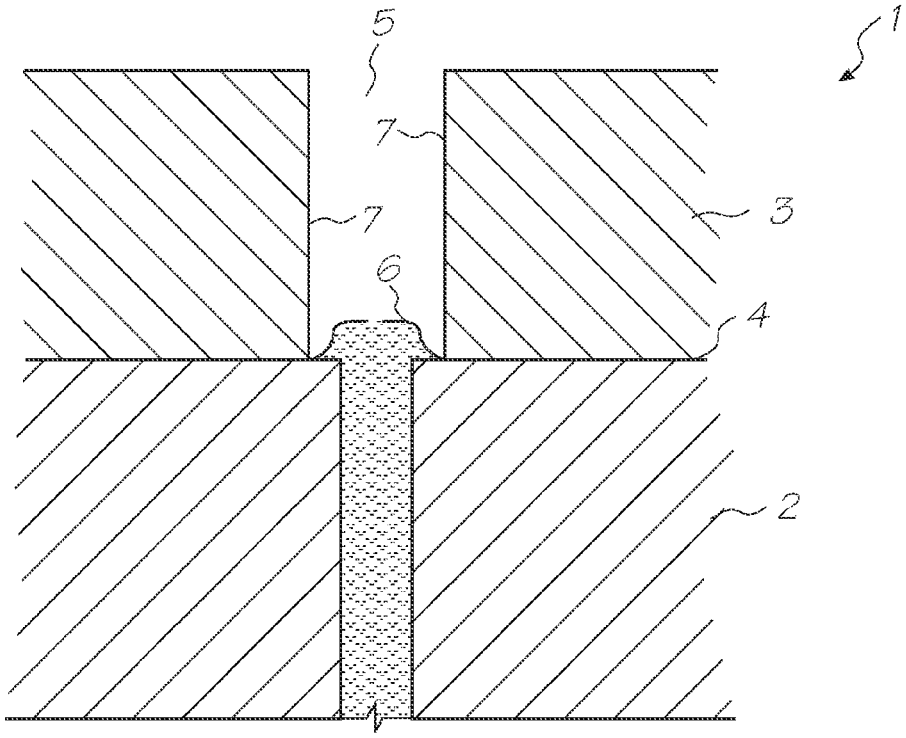
FIG. 1 is a schematic sectional side view of part of a printhead assembly according to a first embodiment.

Referring to FIG. 1, there is shown part of a printhead assembly 1 according to a first embodiment. The printhead assembly 1 comprises a printhead 2 and a nozzle guard 3 formed over an ink ejection surface 4 of the printhead. As shown in FIG. 1, the nozzle guard 3 has a cylindrical channel 5 formed therethrough, which is aligned with a nozzle 6 on the printhead 2. Each nozzle 6 on the printhead has a respective channel 5 in the nozzle guard 3, although for convenience only one nozzle and channel is shown in FIG. 1.

The nozzle guard 3 is formed from hydrophobic photoresist and, hence, the sidewalls 7 of the channel 5 are also hydrophobic. The hydrophobic surfaces of the sidewalls 7 allow microdroplets of ink to rebound off them during printing.

The nozzle guard 2 is fabricated by a depositing a layer of photoresist onto the ink ejection surface 4 and defining channels (e.g. channel 5) therethrough using standard exposure and development techniques. After formation of the channels, the photoresist is UV cured and hardbaked to provide a robust protective nozzle guard 3 over the ink ejection surface 4 of the printhead 2.

Figure 2:
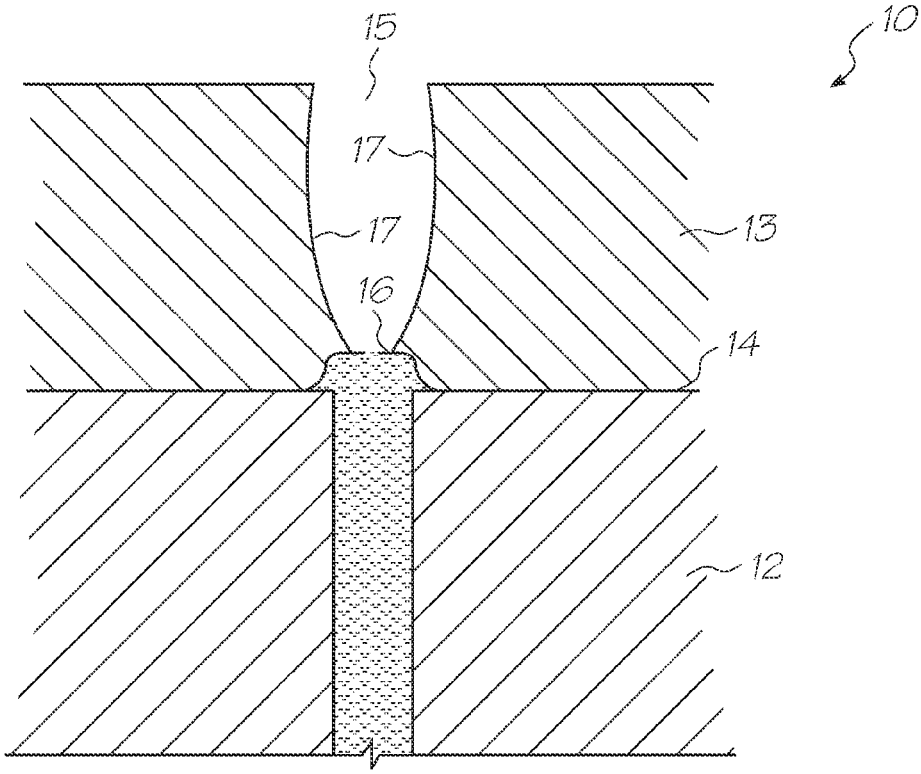
FIG. 2 is schematic sectional side view of part of a printhead assembly according to a second embodiment.

Referring to FIG. 2, there is shown part of a printhead assembly 10 according to a second embodiment. The printhead assembly 10 comprises a printhead 12 and a nozzle guard 13 formed over an ink ejection surface 14 of the printhead. As shown in FIG. 2, the nozzle guard 13 has a cylindrical channel 15 formed therethrough, which is aligned with a nozzle 16 on the printhead 12. Each nozzle 16 on the printhead has a respective channel 15 in the nozzle guard 13, although for convenience only one nozzle and channel is shown in FIG. 2.

The channel 15 is substantially parabolic in cross-section, being radially flared as it extends away from the ink ejection surface 14 of the printhead 12

The nozzle guard 13 is formed from hydrophobic photoresist and, hence, the sidewalls 17 of the channel 15 are also hydrophobic. The hydrophobic surfaces of the sidewalls 17 allow microdroplets of ink to rebound off them during printing.

The nozzle guard 12 is fabricated by a depositing a layer of photoresist onto the ink ejection surface 14 and defining channels (e.g. channel 15) therethrough using standard exposure and development techniques. The focusing condition in the exposure tool (e.g. stepper) is used to provide the flared sidewalls in the channel 15. After formation of the channels, the photoresist is UV cured and hardbaked to provide a robust protective nozzle guard 13 over the ink ejection surface 14 of the printhead 12.

Figure 3:
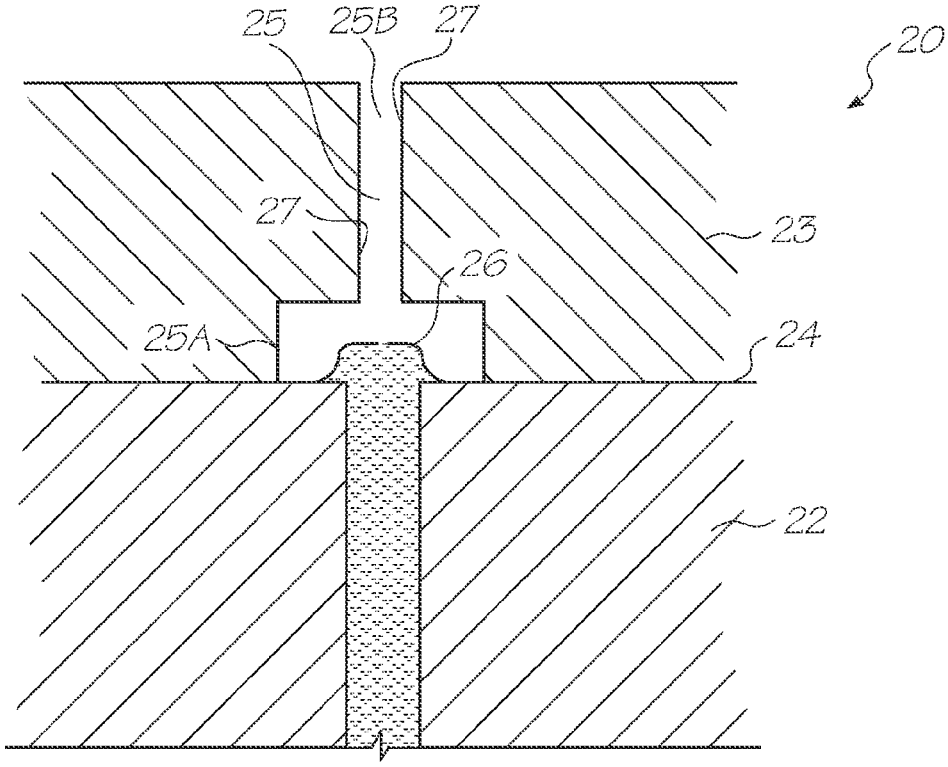
FIG. 3 is schematic sectional side view of part of a printhead assembly according to a third embodiment.

Referring to FIG. 3, there is shown part of a printhead assembly 20 according to a third embodiment. The printhead assembly 20 comprises a printhead 22 and a nozzle guard 23 formed over an ink ejection surface 24 of the printhead. As shown in FIG. 3, the nozzle guard 23 has a cylindrical channel 25 formed therethrough, which is aligned with a nozzle 26 on the printhead 22. Each nozzle 26 on the printhead has a respective channel 25 in the nozzle guard 23, although for convenience only one nozzle and channel is shown in FIG. 3.

The channel 25 has a first portion 25A proximal to the nozzle, and a second portion 25B extending away from the nozzle 26. The first and second portions 25A and 25B are both substantially cylindrical, with the first portion 25A having a larger diameter than the second portion 25B. Hence, the second portion 25B conveniently caps the nozzle 26, while the second portion 25B serves to redirect misdirected ink droplets.

The nozzle guard 23 is formed from hydrophobic photoresist and, hence, the sidewalls 27 of the channel 25 are also hydrophobic. The hydrophobic surfaces of the sidewalls 27 allow microdroplets of ink to rebound off them during printing.

Figure 4A:
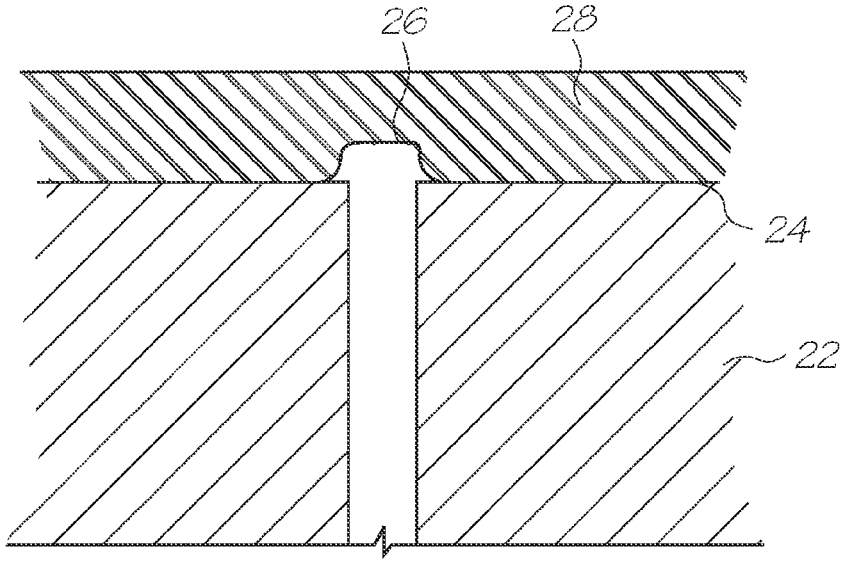
FIGS. 4A-D show the printhead assembly shown in FIG. 3 at various stages of fabrication.
Figure 4B:
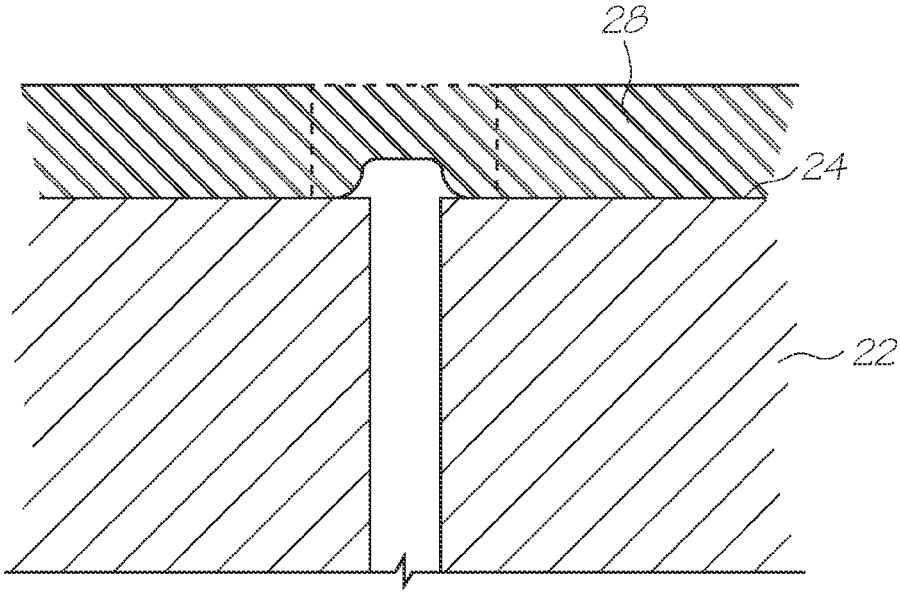
Figure 4C:
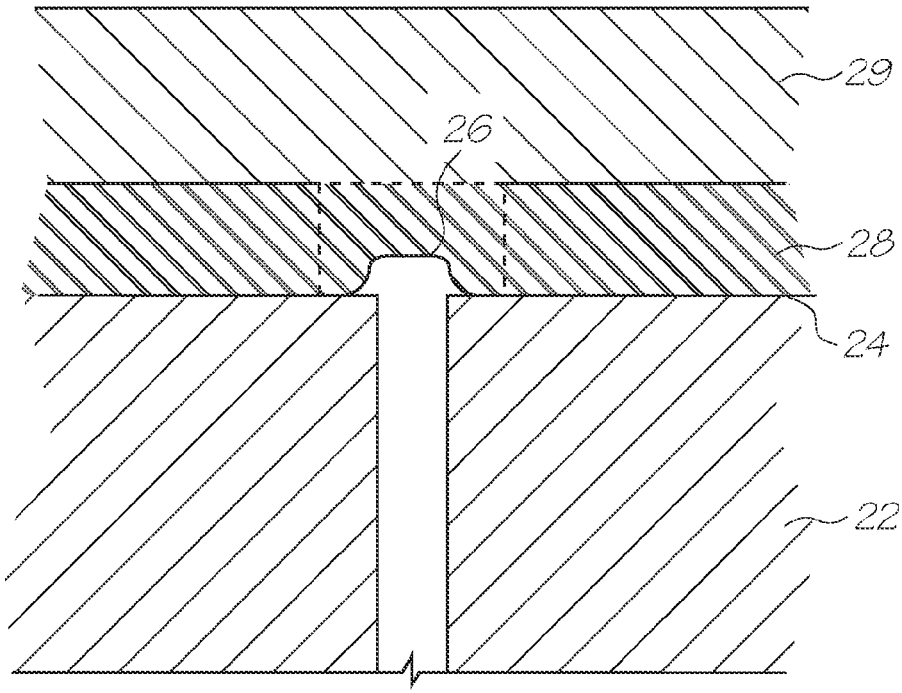
Figure 4D:
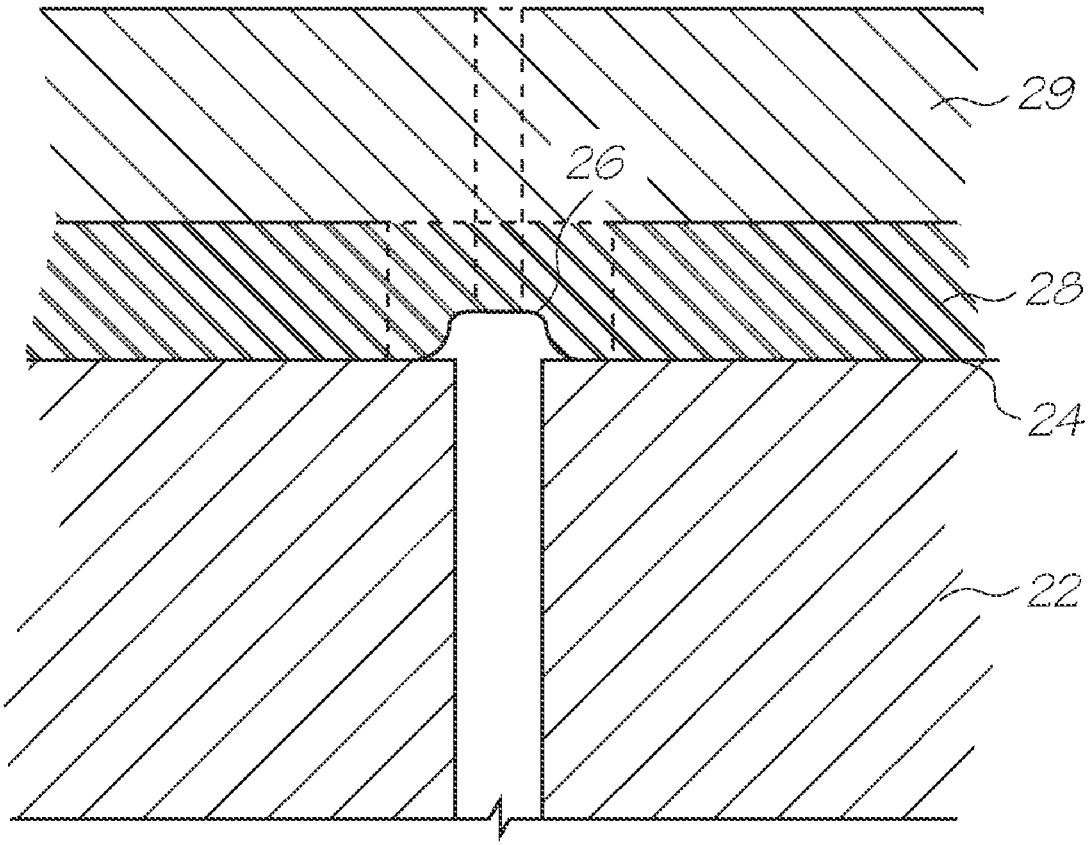

FIGS. 4A-D show fabrication of the printhead assembly 20. In the first step, a first layer of photoresist 28 is deposited onto the ink ejection surface 24 of the printhead 22 and softbaked (FIG. 4A). This first layer of photoresist 28 is then exposed through a first mask, which softens the region of photoresist marked with dashed lines (FIG. 4B). Having exposed the first layer of photoresist 28, a second layer of photoresist 29 is deposited onto the first layer (FIG. 4C). The combined layers of photoresist 28, 29 are then exposed through a second mask, which softens the photoresist shaded with dashed lines (FIG. 4D). Finally, the photoresist 28, 29 is developed, which removes all photoresist exposed during the two exposure steps. After development, an ink channel 25 is defined through the photoresist, as shown in FIG. 3.

After formation of the channels, the photoresist is UV cured and hardbaked to provide a robust protective nozzle guard 23 over the ink ejection surface 24 of the printhead 22.

Figure 5:
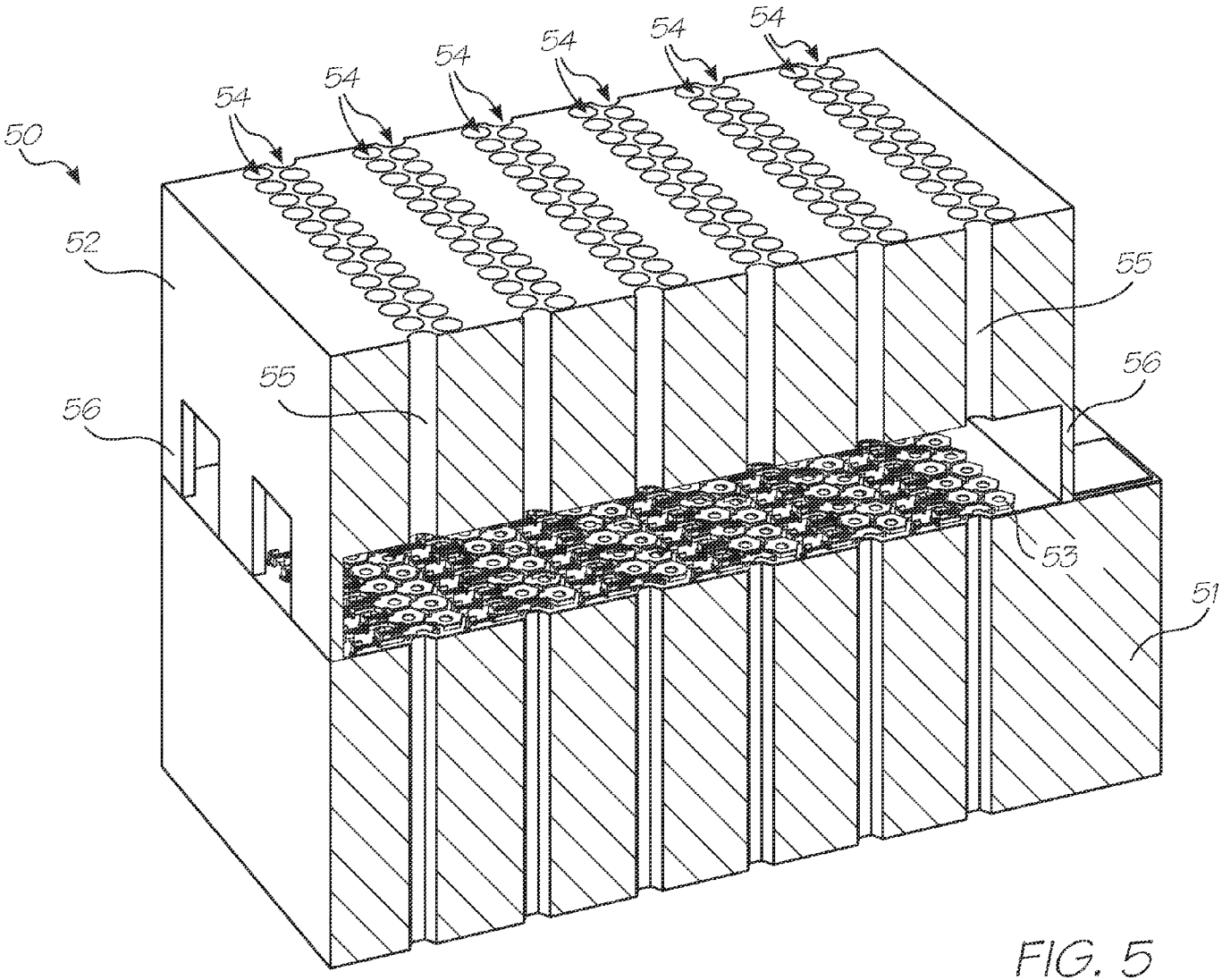
FIG. 5 is schematic sectional side view of part of a printhead assembly according to a fourth embodiment.

Referring to FIG. 5, there is shown part of a printhead assembly 50 according to a fourth embodiment. The printhead assembly 50 comprises a printhead 51 and a nozzle guard 52, which is positioned over an array of nozzles 53 on the printhead. The nozzle guard 52 is formed from silicon as a separate piece from the printhead 51. Since the nozzle guard 52 is formed from silicon, it advantageously has the same coefficient of thermal expansion as the printhead 51, which is formed on a silicon substrate.

An array of channels 54 are defined through the nozzle guard 52, with each channel 54 being aligned with a respective nozzle 53 on the printhead 51. Each channel 54 has hydrophobic sidewalls 55 by virtue of a hydrophobic coating, usually a polymeric coating. The hydrophobic surfaces of the sidewalls 55 allow microdroplets of ink to rebound off them during printing.

The nozzle guard 52 is fabricated from a silicon substrate by standard lithographic mask/etch techniques. Any anisotropic etch technique may be used to define the channels through the nozzle guard 52. However, the Bosch etch (U.S. Pat. No. 5,501,893 and U.S. Pat. No. 6,284,148) is particularly advantageous, because it leaves a hydrophobic polymeric coating on the trench sidewalls. Normally, this hydrophobic coating is removed by an EKC clean-up step and/or plasma stripping. However, in the present invention, the polymeric coating can remain on the sidewalls and be used to provide a hydrophobic surface for rebounding ink droplets.

The nozzle guard 52 is bonded to the printhead 51 by bonding support struts 56 on the nozzle guard 50 to the printhead 51, whilst keeping the nozzles 10 and corresponding channels 54 in proper alignment. Any suitable bonding process, such as adhesive bonding, may be used for bonding the nozzle guard 50 and the printhead 51 together.

Droplet Ejection

Figure 6:
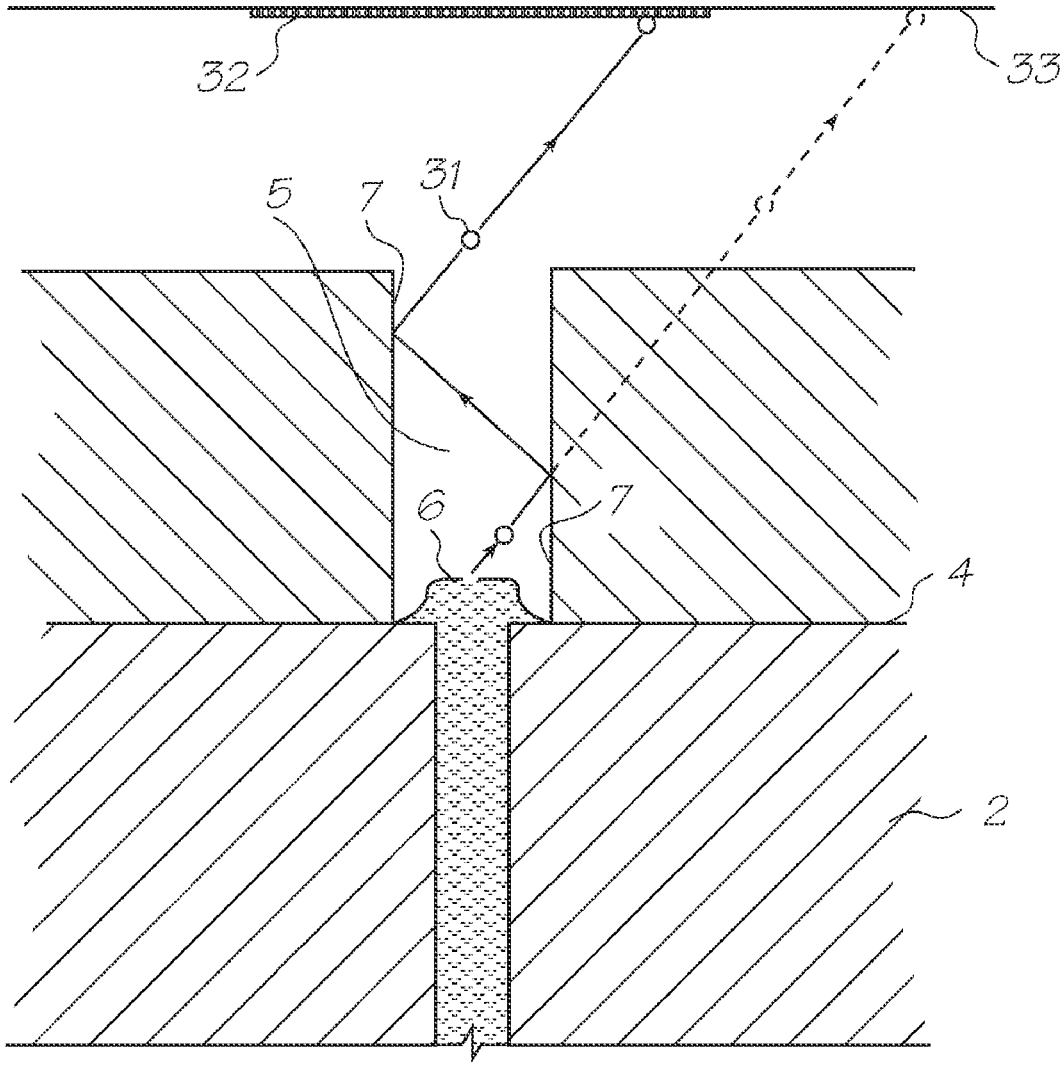
FIG. 6 shows the trajectory of an ejected ink droplet through the channel shown in FIG. 1.

Referring to FIG. 6, there is shown the trajectory of an ejected ink droplet 31 through the channel 5 of the printhead assembly 1 according to the first embodiment. The droplet 31 is directed by the nozzle guard 3 onto a target print zone 32 of a print medium 33. It will be seen that the two rebounds off the sidewalls 7 of the channel 5 redirect the droplet from its initial misdirected trajectory (shown in dashed lines) onto a more favourable trajectory (shown in solid lines). Without the nozzle guard in place, it will readily appreciated that the droplet 31 would not strike the target print zone 32.

Figure 7:
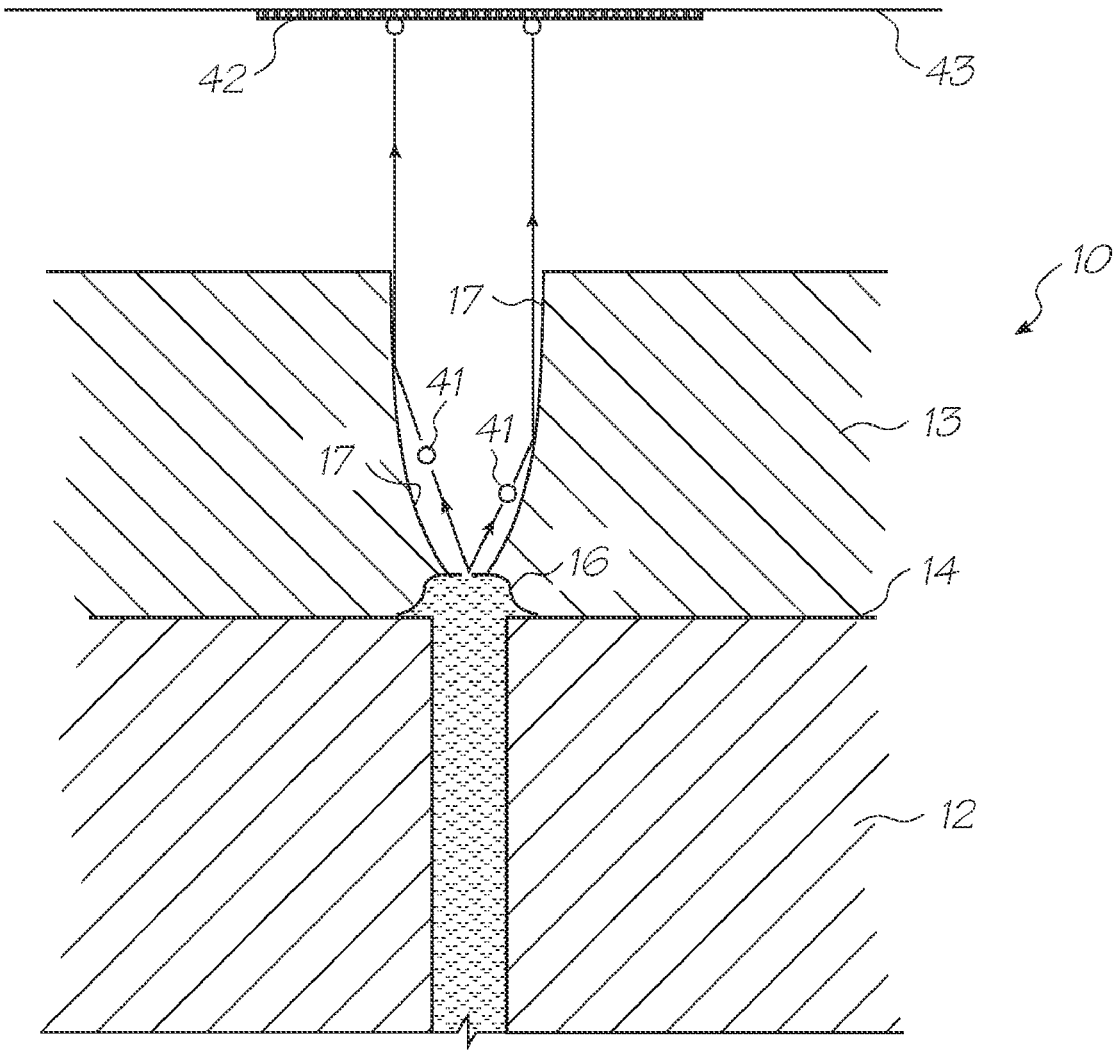
FIG. 7 shows the trajectory of an ejected ink droplet through the channel shown in FIG. 2.

Referring to FIG. 7, there is shown the trajectory of ejected ink droplets 41 through the channel 15 of the printhead assembly 10 according to the second embodiment. The droplets 41 are directed by the nozzle guard 13 onto a target print zone 42 of a print medium 43. It will be seen that, due to the parabolic curvature of the sidewalls 17, all the ink droplets 42 are redirected substantially perpendicularly to the ink ejection surface 14 and onto the target print zone 42, irrespective of their initial trajectory.

Inkjet Nozzles

The invention is suitable for use with any type of inkjet printhead and any type of inkjet nozzle design. The Applicant has developed many different types of inkjet printheads and inkjet nozzles, which are described in detail in the cross-referenced applications. For completeness, some of the Applicant's inkjet nozzles will now be described with reference to FIGS. 8-21.

Figure 16:
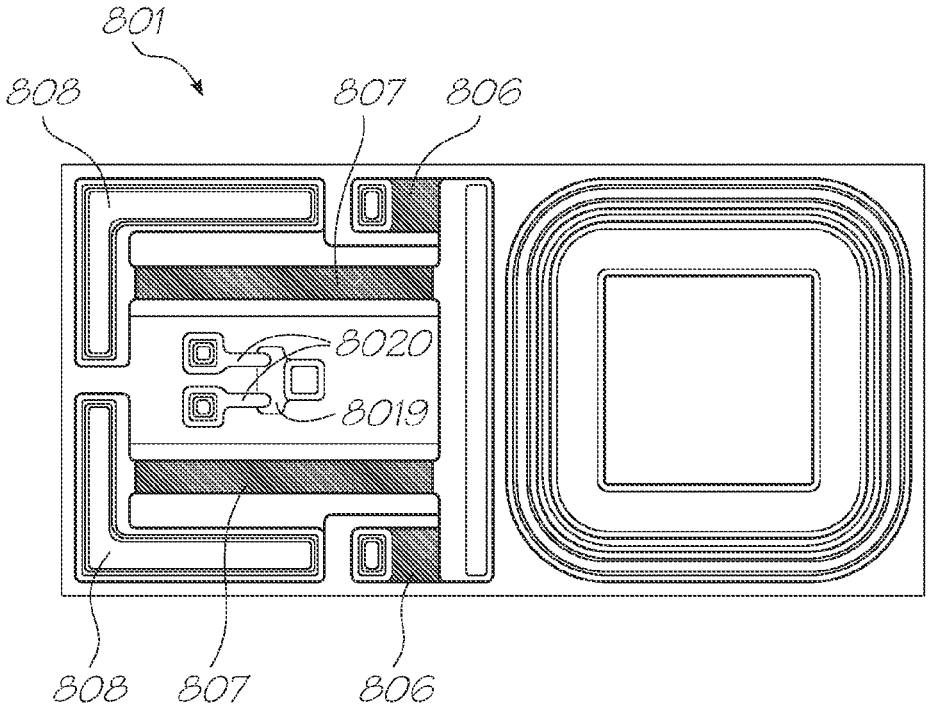
FIG. 16 shows a plan view of the nozzle of FIG. 8 with the lever arm and movable nozzle removed for clarity.
Figure 17:
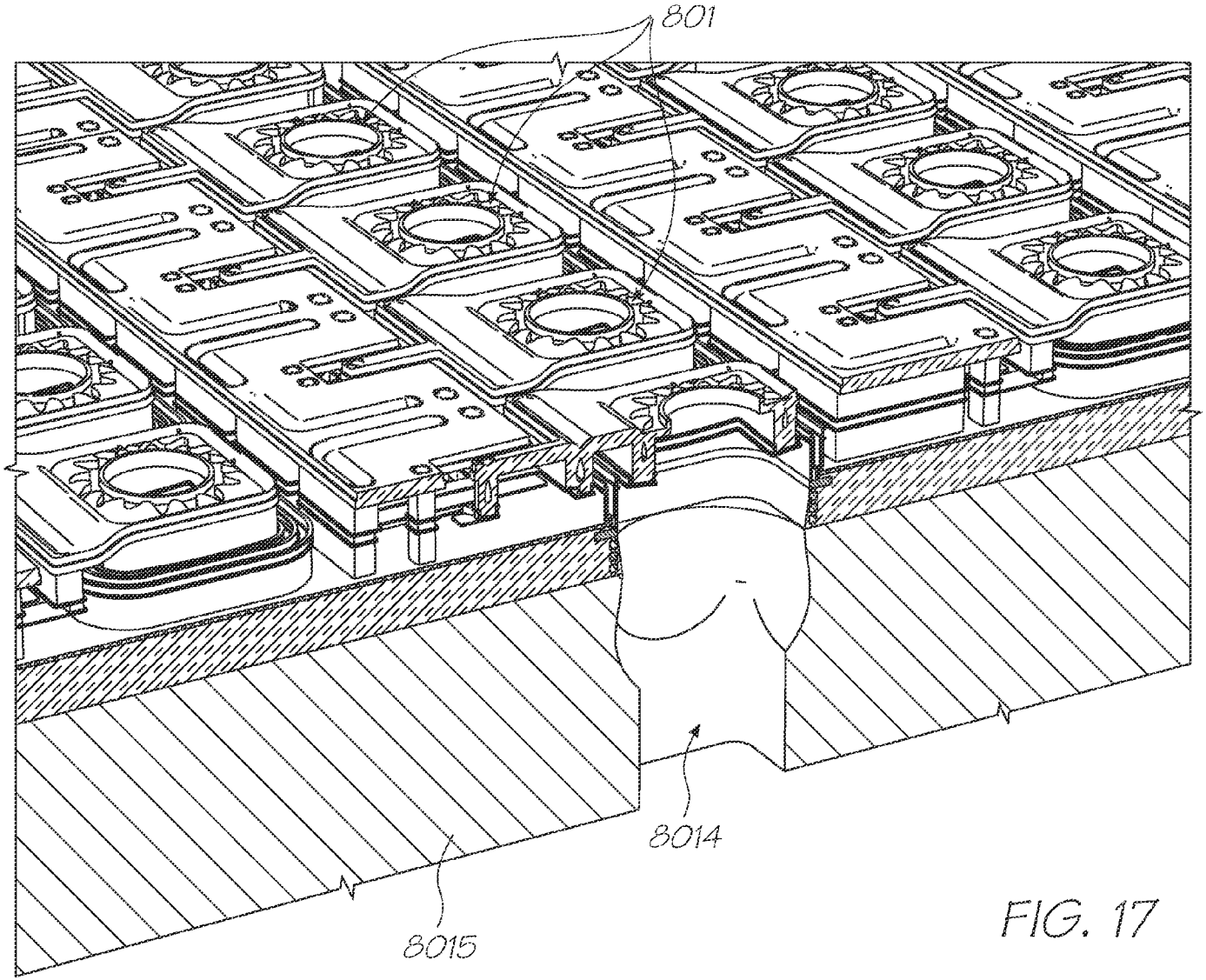
FIG. 17 shows a perspective vertical sectional view of a part of a printhead chip incorporating a plurality of the nozzle arrangements of the type shown in FIG. 8.

One example of a type of ink delivery nozzle arrangement suitable for the present invention, comprising a nozzle and corresponding actuator, will now be described with reference to FIGS. 8 to 17. FIG. 17 shows an array of ink delivery nozzle arrangements 801 formed on a silicon substrate 8015. Each of the nozzle arrangements 801 are identical, however groups of nozzle arrangements 801 are arranged to be fed with different colored inks or fixative. In this regard, the nozzle arrangements are arranged in rows and are staggered with respect to each other, allowing closer spacing of ink dots during printing than would be possible with a single row of nozzles. Such an arrangement makes it possible to provide a high density of nozzles, for example, more than 5000 nozzles arrayed in a plurality of staggered rows each having an interspacing of about 32 microns between the nozzles in each row and about 80 microns between the adjacent rows. The multiple rows also allow for redundancy (if desired), thereby allowing for a predetermined failure rate per nozzle.

Each nozzle arrangement 801 is the product of an integrated circuit fabrication technique. In particular, the nozzle arrangement 801 defines a micro-electromechanical system (MEMS).

For clarity and ease of description, the construction and operation of a single nozzle arrangement 801 will be described with reference to FIGS. 8 to 16.

A silicon wafer substrate 8015 has a 0.35 micron 1 P4M 12 volt CMOS microprocessing electronics positioned thereon.

A silicon dioxide (or alternatively glass) layer 8017 is positioned on the substrate 8015. The silicon dioxide layer 8017 defines CMOS dielectric layers. CMOS top-level metal defines a pair of aligned aluminium electrode contact layers 8030 positioned on the silicon dioxide layer 8017. Both the silicon wafer substrate 8015 and the silicon dioxide layer 8017 are etched to define an ink inlet channel 8014 having a generally circular cross section (in plan). An aluminium diffusion barrier 8028 of CMOS metal 1, CMOS metal 2/3 and CMOS top level metal is positioned in the silicon dioxide layer 8017 about the ink inlet channel 8014. The diffusion barrier 8028 serves to inhibit the diffusion of hydroxyl ions through CMOS oxide layers of the drive electronics layer 8017.

A passivation layer in the form of a layer of silicon nitride 8031 is positioned over the aluminium contact layers 8030 and the silicon dioxide layer 8017. Each portion of the passivation layer 8031 positioned over the contact layers 8030 has an opening 8032 defined therein to provide access to the contacts 8030.

Figure 11:
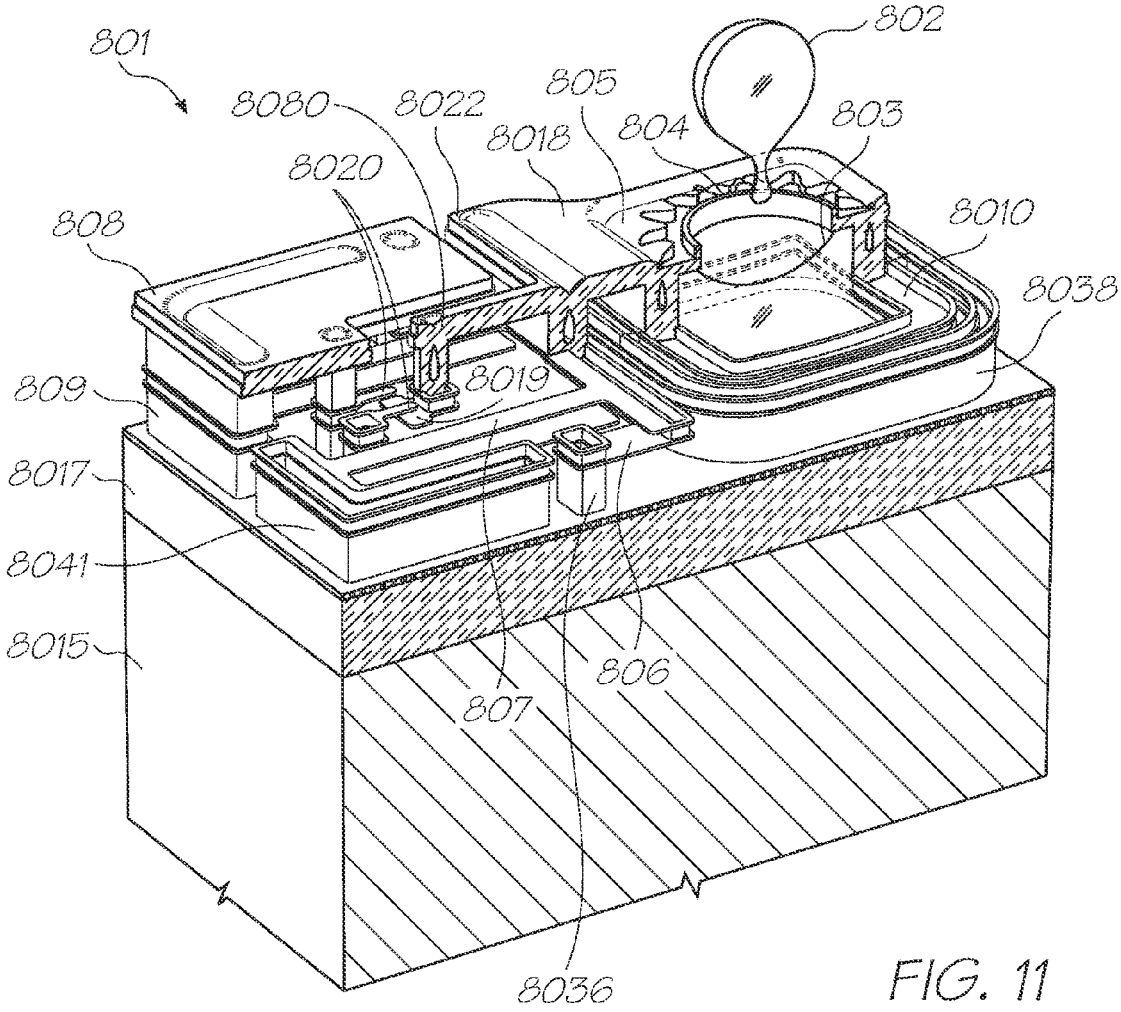
FIG. 11 shows a perspective partial vertical sectional view of the nozzle of FIG. 8, at the actuation state shown in FIG. 10.
Figure 12:
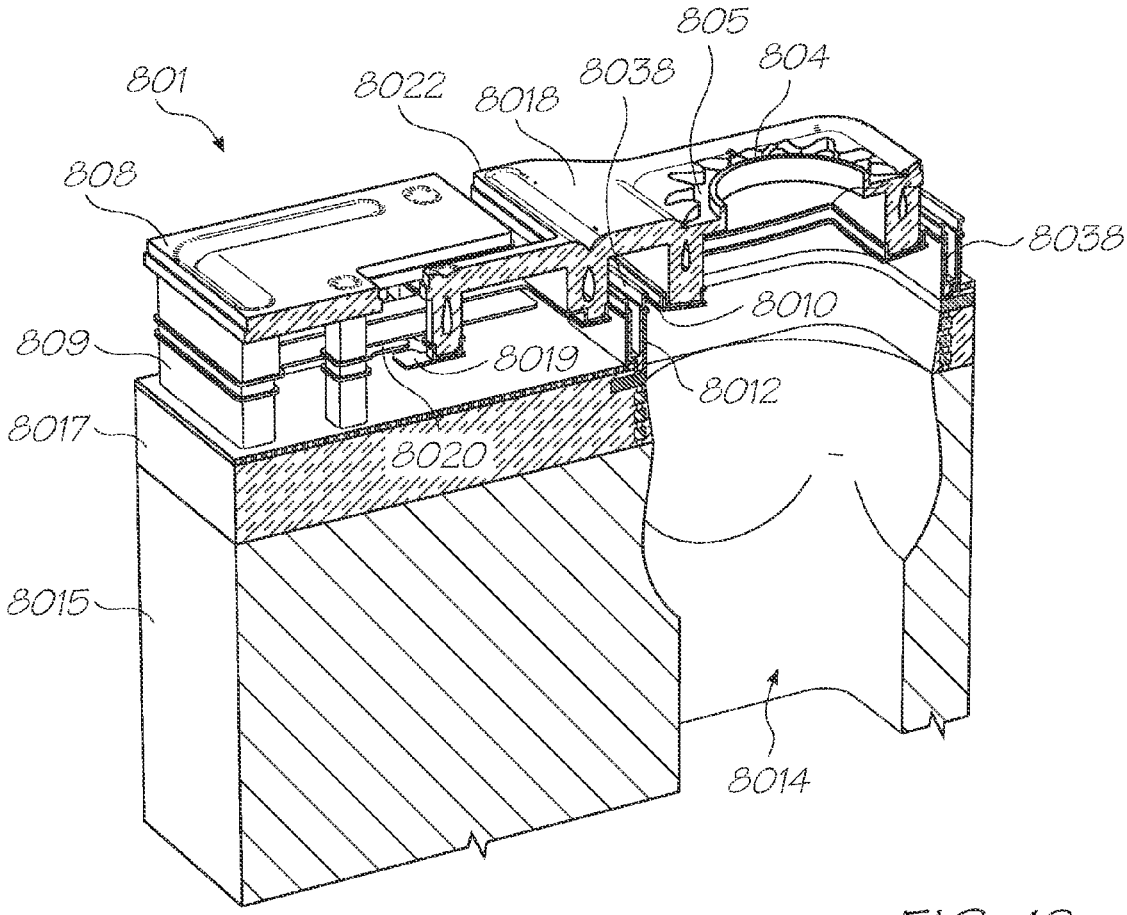
FIG. 12 shows a perspective vertical section of the nozzle of FIG. 8, with ink omitted.
Figure 13:
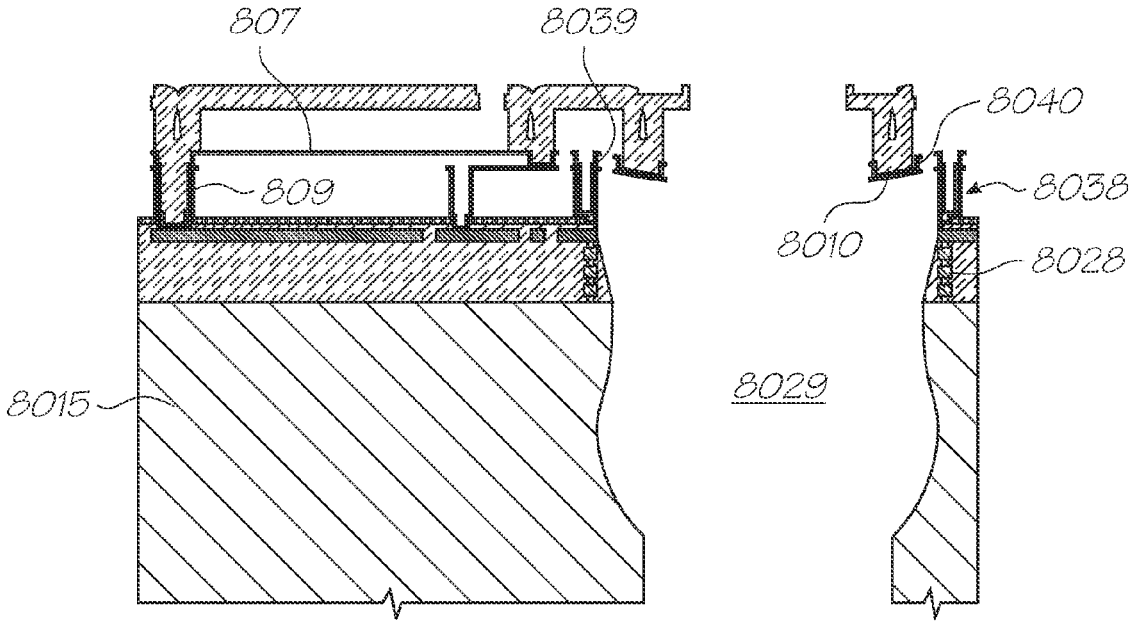
FIG. 13 shows a vertical sectional view of the of the nozzle of FIG. 12.

The nozzle arrangement 801 includes a nozzle chamber 8029 defined by an annular nozzle wall 8033, which terminates at an upper end in a nozzle roof 8034 and a radially inner nozzle rim 804 that is circular in plan. The ink inlet channel 8014 is in fluid communication with the nozzle chamber 8029. At a lower end of the nozzle wall, there is disposed a moving rim 8010, that includes a moving seal lip 8040. An encircling wall 8038 surrounds the movable nozzle, and includes a stationary seal lip 8039 that, when the nozzle is at rest as shown in FIG. 11, is adjacent the moving rim 8010. A fluidic seal 8011 is formed due to the surface tension of ink trapped between the stationary seal lip 8039 and the moving seal lip 8040. This prevents leakage of ink from the chamber whilst providing a low resistance coupling between the encircling wall 8038 and the nozzle wall 8033.

Figure 15:
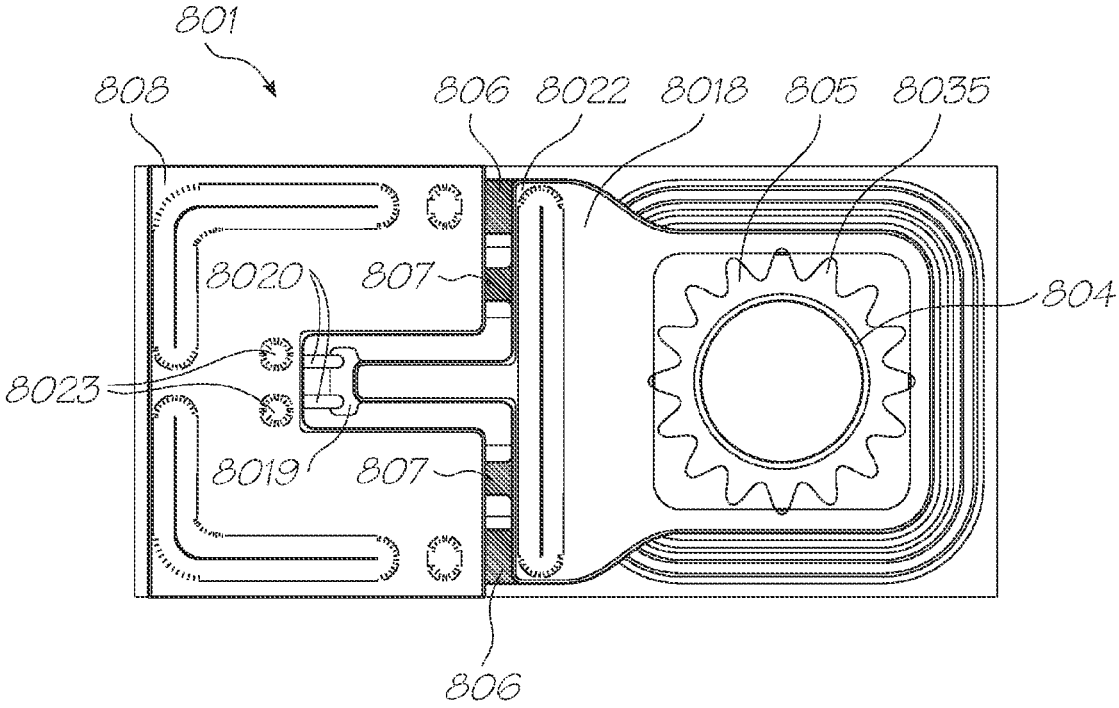
FIG. 15 shows a plan view of the nozzle of FIG. 8.

As best shown in FIG. 15, a plurality of radially extending recesses 8035 is defined in the roof 8034 about the nozzle rim 804. The recesses 8035 serve to contain radial ink flow as a result of ink escaping past the nozzle rim 804.

The nozzle wall 8033 forms part of a lever arrangement that is mounted to a carrier 8036 having a generally U-shaped profile with a base 8037 attached to the layer 8031 of silicon nitride.

The lever arrangement also includes a lever arm 8018 that extends from the nozzle walls and incorporates a lateral stiffening beam 8022. The lever arm 8018 is attached to a pair of passive beams 806, formed from titanium nitride (TiN) and positioned on either side of the nozzle arrangement, as best shown in FIGS. 11 and 16. The other ends of the passive beams 806 are attached to the carrier 8036.

The lever arm 8018 is also attached to an actuator beam 807, which is formed from TiN. It will be noted that this attachment to the actuator beam is made at a point a small but critical distance higher than the attachments to the passive beam 806.

Figure 8:
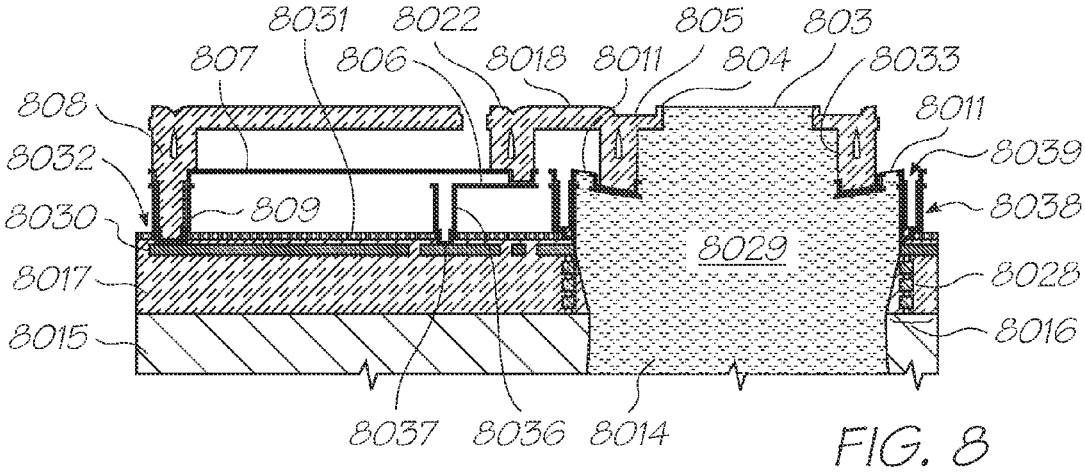
FIG. 8 shows a vertical sectional view of a single nozzle for ejecting ink, for use with the invention, in a quiescent state.
Figure 14:
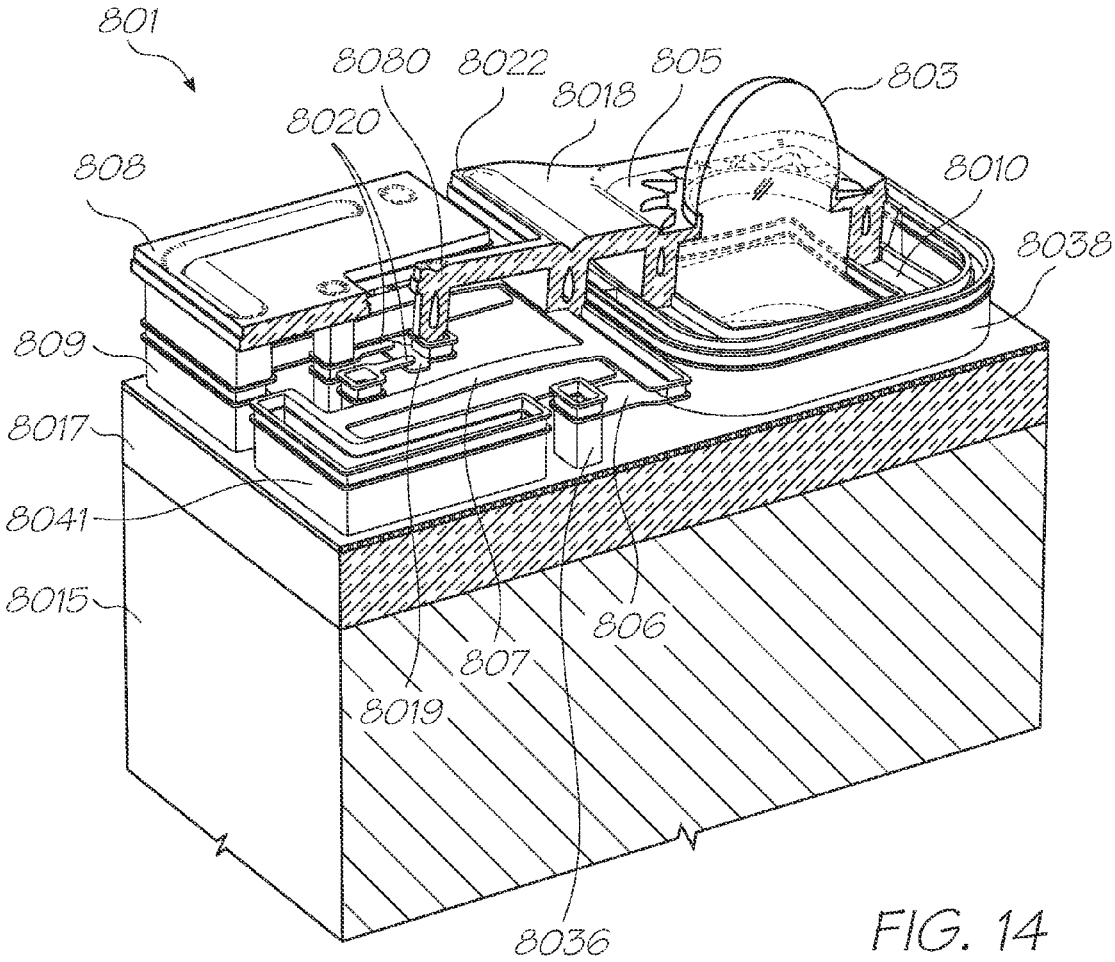
FIG. 14 shows a perspective partial vertical sectional view of the nozzle of FIG. 8, at the actuation state shown in FIG. 9.

As best shown in FIGS. 8 and 14, the actuator beam 807 is substantially U-shaped in plan, defining a current path between the electrode 809 and an opposite electrode 8041. Each of the electrodes 809 and 8041 are electrically connected to respective points in the contact layer 8030. As well as being electrically coupled via the contacts 809, the actuator beam is also mechanically anchored to anchor 808. The anchor 808 is configured to constrain motion of the actuator beam 807 to the left of FIGS. 11 to 13 when the nozzle arrangement is in operation.

The TiN in the actuator beam 807 is conductive, but has a high enough electrical resistance that it undergoes self-heating when a current is passed between the electrodes 809 and 8041. No current flows through the passive beams 806, so they do not expand.

In use, the device at rest is filled with ink 8013 that defines a meniscus 803 under the influence of surface tension. The ink is retained in the chamber 8029 by the meniscus, and will not generally leak out in the absence of some other physical influence.

Figure 9:
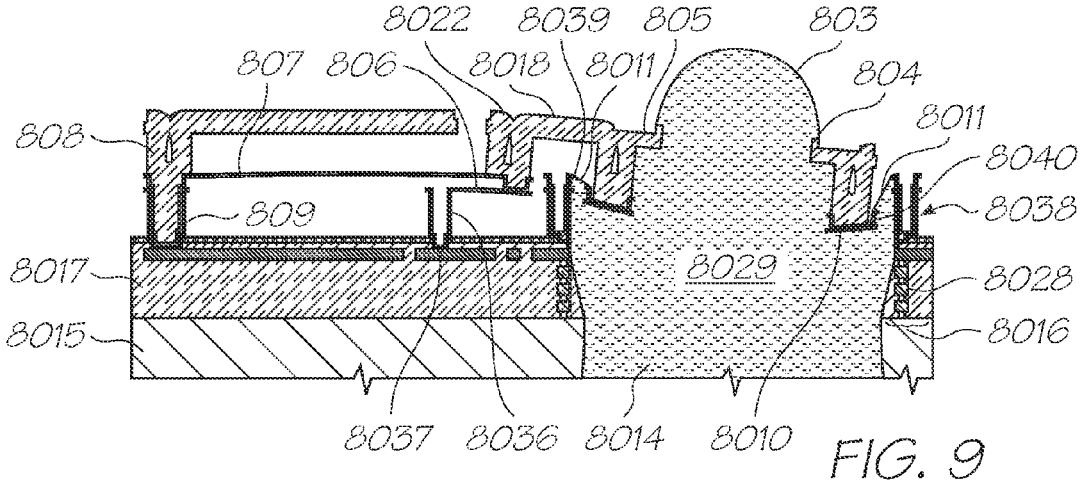
FIG. 9 shows a vertical sectional view of the nozzle of FIG. 8 during an initial actuation phase.

As shown in FIG. 9, to fire ink from the nozzle, a current is passed between the contacts 809 and 8041, passing through the actuator beam 807. The self-heating of the beam 807 due to its resistance causes the beam to expand. The dimensions and design of the actuator beam 807 mean that the majority of the expansion in a horizontal direction with respect to FIGS. 8 to 10. The expansion is constrained to the left by the anchor 808, so the end of the actuator beam 807 adjacent the lever arm 8018 is impelled to the right.

The relative horizontal inflexibility of the passive beams 806 prevents them from allowing much horizontal movement the lever arm 8018. However, the relative displacement of the attachment points of the passive beams and actuator beam respectively to the lever arm causes a twisting movement that causes the lever arm 8018 to move generally downwards. The movement is effectively a pivoting or hinging motion. However, the absence of a true pivot point means that the rotation is about a pivot region defined by bending of the passive beams 806.

The downward movement (and slight rotation) of the lever arm 8018 is amplified by the distance of the nozzle wall 8033 from the passive beams 806. The downward movement of the nozzle walls and roof causes a pressure increase within the chamber 8029, causing the meniscus to bulge as shown in FIG. 9. It will be noted that the surface tension of the ink means the fluid seal 8011 is stretched by this motion without allowing ink to leak out.

Figure 10:
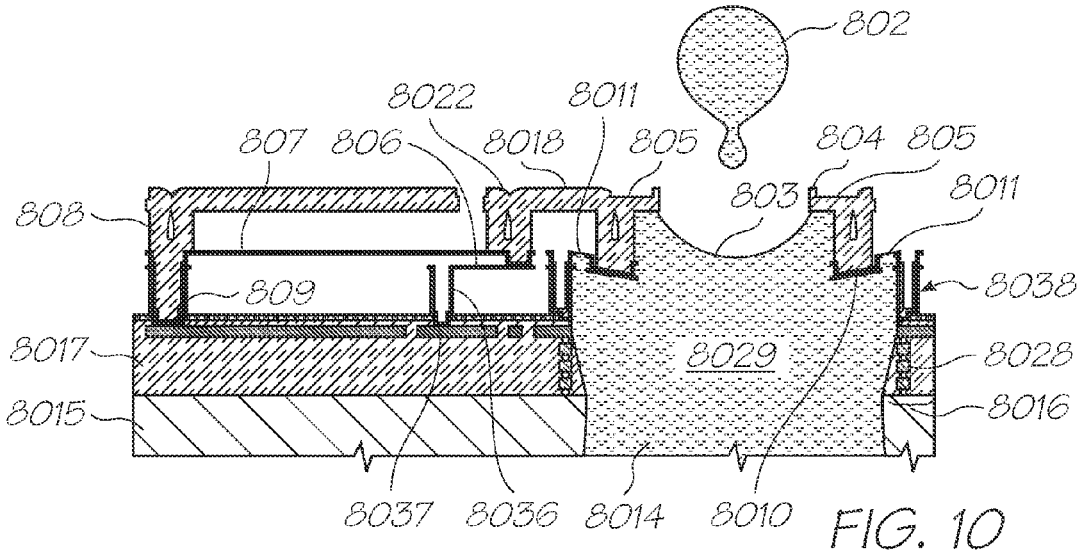
FIG. 10 shows a vertical sectional view of the nozzle of FIG. 9 later in the actuation phase.

As shown in FIG. 10, at the appropriate time, the drive current is stopped and the actuator beam 807 quickly cools and contracts. The contraction causes the lever arm to commence its return to the quiescent position, which in turn causes a reduction in pressure in the chamber 8029. The interplay of the momentum of the bulging ink and its inherent surface tension, and the negative pressure caused by the upward movement of the nozzle chamber 8029 causes thinning, and ultimately snapping, of the bulging meniscus to define an ink drop 802 that continues upwards until it contacts adjacent print media.

Immediately after the drop 802 detaches, meniscus 803 forms the concave shape shown in FIG. 10. Surface tension causes the pressure in the chamber 8029 to remain relatively low until ink has been sucked upwards through the inlet 8014, which returns the nozzle arrangement and the ink to the quiescent situation shown in FIG. 8.

Another type of printhead nozzle arrangement suitable for the present invention will now be described with reference to FIG. 18. Once again, for clarity and ease of description, the construction and operation of a single nozzle arrangement 1001 will be described.

The nozzle arrangement 1001 is of a bubble forming heater element actuator type which comprises a nozzle plate 1002 with a nozzle 1003 therein, the nozzle having a nozzle rim 1004, and aperture 1005 extending through the nozzle plate. The nozzle plate 1002 is plasma etched from a silicon nitride structure which is deposited, by way of chemical vapour deposition (CVD), over a sacrificial material which is subsequently etched.

The nozzle arrangement includes, with respect to each nozzle 1003, side walls 1006 on which the nozzle plate is supported, a chamber 1007 defined by the walls and the nozzle plate 1002, a multi-layer substrate 1008 and an inlet passage 1009 extending through the multi-layer substrate to the far side (not shown) of the substrate. A looped, elongate heater element 1010 is suspended within the chamber 1007, so that the element is in the form of a suspended beam. The nozzle arrangement as shown is a microelectromechanical system (MEMS) structure, which is formed by a lithographic process.

When the nozzle arrangement is in use, ink 1011 from a reservoir (not shown) enters the chamber 1007 via the inlet passage 1009, so that the chamber fills. Thereafter, the heater element 1010 is heated for somewhat less than 1 micro second, so that the heating is in the form of a thermal pulse. It will be appreciated that the heater element 1010 is in thermal contact with the ink 1011 in the chamber 1007 so that when the element is heated, this causes the generation of vapor bubbles in the ink. Accordingly, the ink 1011 constitutes a bubble forming liquid.

The bubble 1012, once generated, causes an increase in pressure within the chamber 1007, which in turn causes the ejection of a drop 1016 of the ink 1011 through the nozzle 1003. The rim 1004 assists in directing the drop 1016 as it is ejected, so as to minimize the chance of a drop misdirection.

The reason that there is only one nozzle 1003 and chamber 1007 per inlet passage 1009 is so that the pressure wave generated within the chamber, on heating of the element 1010 and forming of a bubble 1012, does not effect adjacent chambers and their corresponding nozzles.

The increase in pressure within the chamber 1007 not only pushes ink 1011 out through the nozzle 1003, but also pushes some ink back through the inlet passage 1009. However, the inlet passage 1009 is approximately 200 to 300 microns in length, and is only approximately 16 microns in diameter. Hence there is a substantial viscous drag. As a result, the predominant effect of the pressure rise in the chamber 1007 is to force ink out through the nozzle 1003 as an ejected drop 1016, rather than back through the inlet passage 1009.

Figure 18:
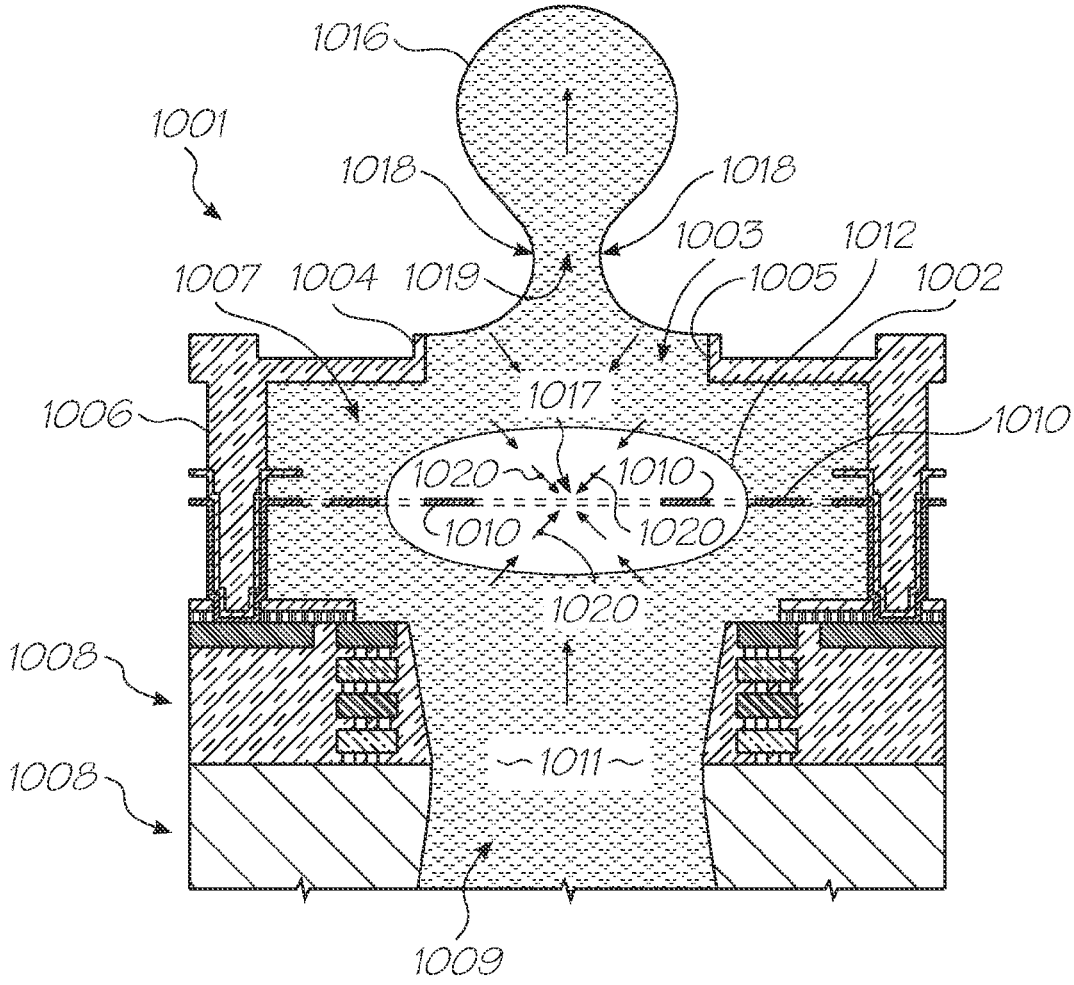
FIG. 18 shows a schematic cross-sectional view through an ink chamber of a single nozzle for injecting ink of a bubble forming heater element actuator type.

As shown in FIG. 18, the ink drop 1016 is being ejected is shown during its "necking phase" before the drop breaks off. At this stage, the bubble 1012 has already reached its maximum size and has then begun to collapse towards the point of collapse 1017.

The collapsing of the bubble 1012 towards the point of collapse 1017 causes some ink 1011 to be drawn from within the nozzle 1003 (from the sides 1018 of the drop), and some to be drawn from the inlet passage 1009, towards the point of collapse. Most of the ink 1011 drawn in this manner is drawn from the nozzle 1003, forming an annular neck 1019 at the base of the drop 1016 prior to its breaking off.

The drop 1016 requires a certain amount of momentum to overcome surface tension forces, in order to break off. As ink 1011 is drawn from the nozzle 1003 by the collapse of the bubble 1012, the diameter of the neck 1019 reduces thereby reducing the amount of total surface tension holding the drop, so that the momentum of the drop as it is ejected out of the nozzle is sufficient to allow the drop to break off.

When the drop 1016 breaks off, cavitation forces are caused as reflected by the arrows 1020, as the bubble 1012 collapses to the point of collapse 1017. It will be noted that there are no solid surfaces in the vicinity of the point of collapse 1017 on which the cavitation can have an effect.

Yet another type of printhead nozzle arrangement suitable for the present invention will now be described with reference to FIGS. 19-21. This type typically provides an ink delivery nozzle arrangement having a nozzle chamber containing ink and a thermal bend actuator connected to a paddle positioned within the chamber. The thermal actuator device is actuated so as to eject ink from the nozzle chamber. The preferred embodiment includes a particular thermal bend actuator which includes a series of tapered portions for providing conductive heating of a conductive trace. The actuator is connected to the paddle via an arm received through a slotted wall of the nozzle chamber. The actuator arm has a mating shape so as to mate substantially with the surfaces of the slot in the nozzle chamber wall.

Figure 19A:
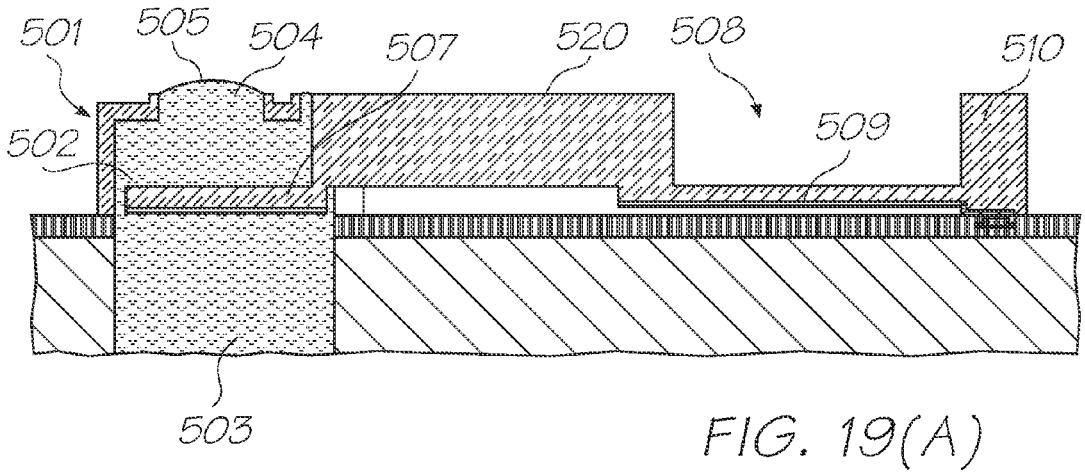
FIGS. 19A to 19C show the basic operational principles of a thermal bend actuator.
Figure 19B:
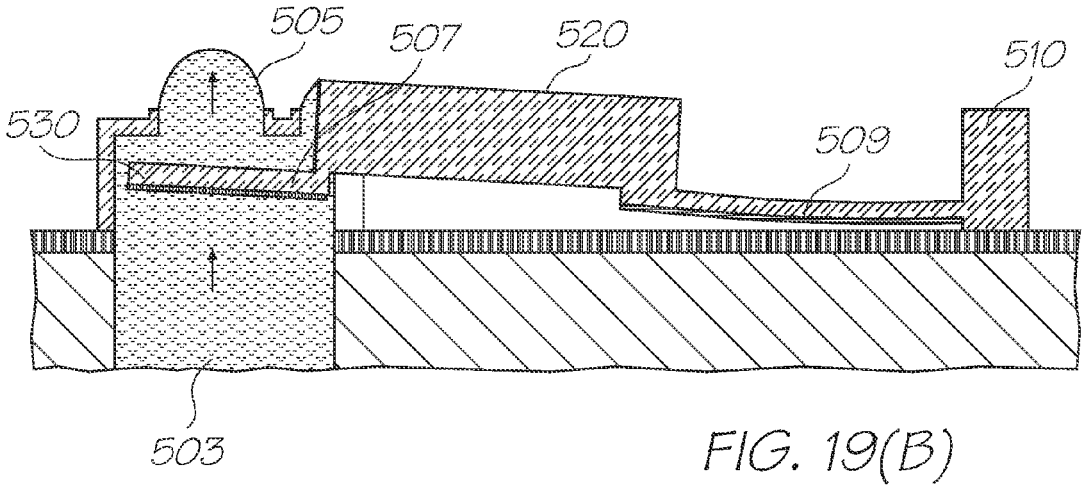
Figure 19C:
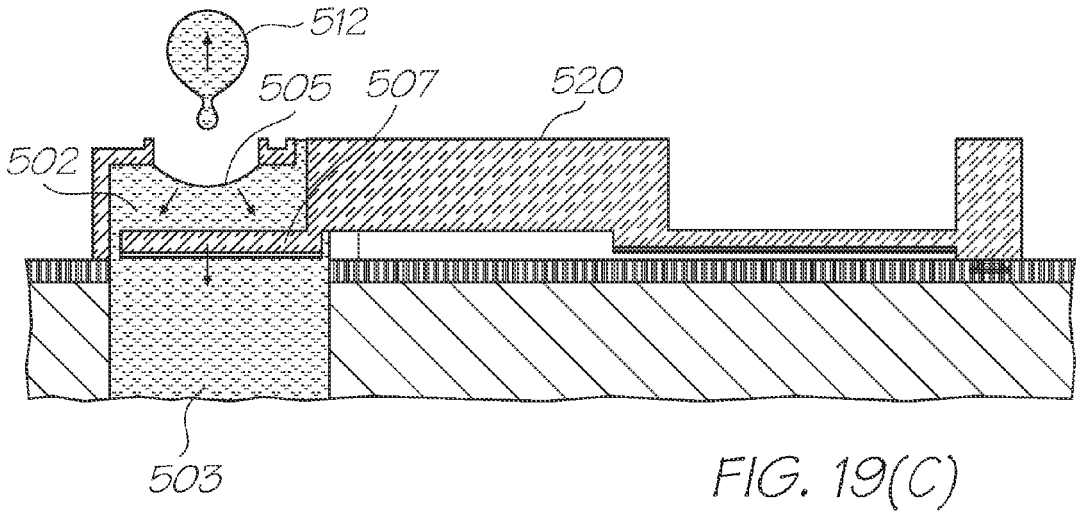

Turning initially to FIGS. 19(*a*)-(*c*), there is provided schematic illustrations of the basic operation of a nozzle arrangement of this embodiment. A nozzle chamber 501 is provided filled with ink 502 by means of an ink inlet channel 503 which can be etched through a wafer substrate on which the nozzle chamber 501 rests. The nozzle chamber 501 further includes an ink ejection port 504 around which an ink meniscus forms.

Inside the nozzle chamber 501 is a paddle type device 507 which is interconnected to an actuator 508 through a slot in the wall of the nozzle chamber 501. The actuator 508 includes a heater means e.g. 509 located adjacent to an end portion of a post 510. The post 510 is fixed to a substrate.

When it is desired to eject a drop from the nozzle chamber 501, as illustrated in FIG. 19(*b*), the heater means 509 is heated so as to undergo thermal expansion. Preferably, the heater means 509 itself or the other portions of the actuator 508 are built from materials having a high bend efficiency where the bend efficiency is defined as:

$$\text{bend efficiency} = \frac{\text{Young's Modulus} \times (\text{Coefficient of thermal Expansion})}{\text{Density} \times \text{Specific Heat Capacity}}$$

A suitable material for the heater elements is a copper nickel alloy which can be formed so as to bend a glass material.

The heater means 509 is ideally located adjacent the end portion of the post 510 such that the effects of activation are magnified at the paddle end 507 such that small thermal expansions near the post 510 result in large movements of the paddle end.

The heater means 509 and consequential paddle movement causes a general increase in pressure around the ink meniscus 505 which expands, as illustrated in FIG. 19(*b*), in a rapid manner. The heater current is pulsed and ink is ejected out of the port 504 in addition to flowing in from the ink channel 503.

Subsequently, the paddle 507 is deactivated to again return to its quiescent position. The deactivation causes a general reflow of the ink into the nozzle chamber. The forward momentum of the ink outside the nozzle rim and the corresponding backflow results in a general necking and breaking off of the drop 512 which proceeds to the print media. The collapsed meniscus 505 results in a general sucking of ink into the nozzle chamber 502 via the ink flow channel 503. In time, the nozzle chamber 501 is refilled such that the position in FIG. 19(*a*) is again reached and the nozzle chamber is subsequently ready for the ejection of another drop of ink.

Figure 20:
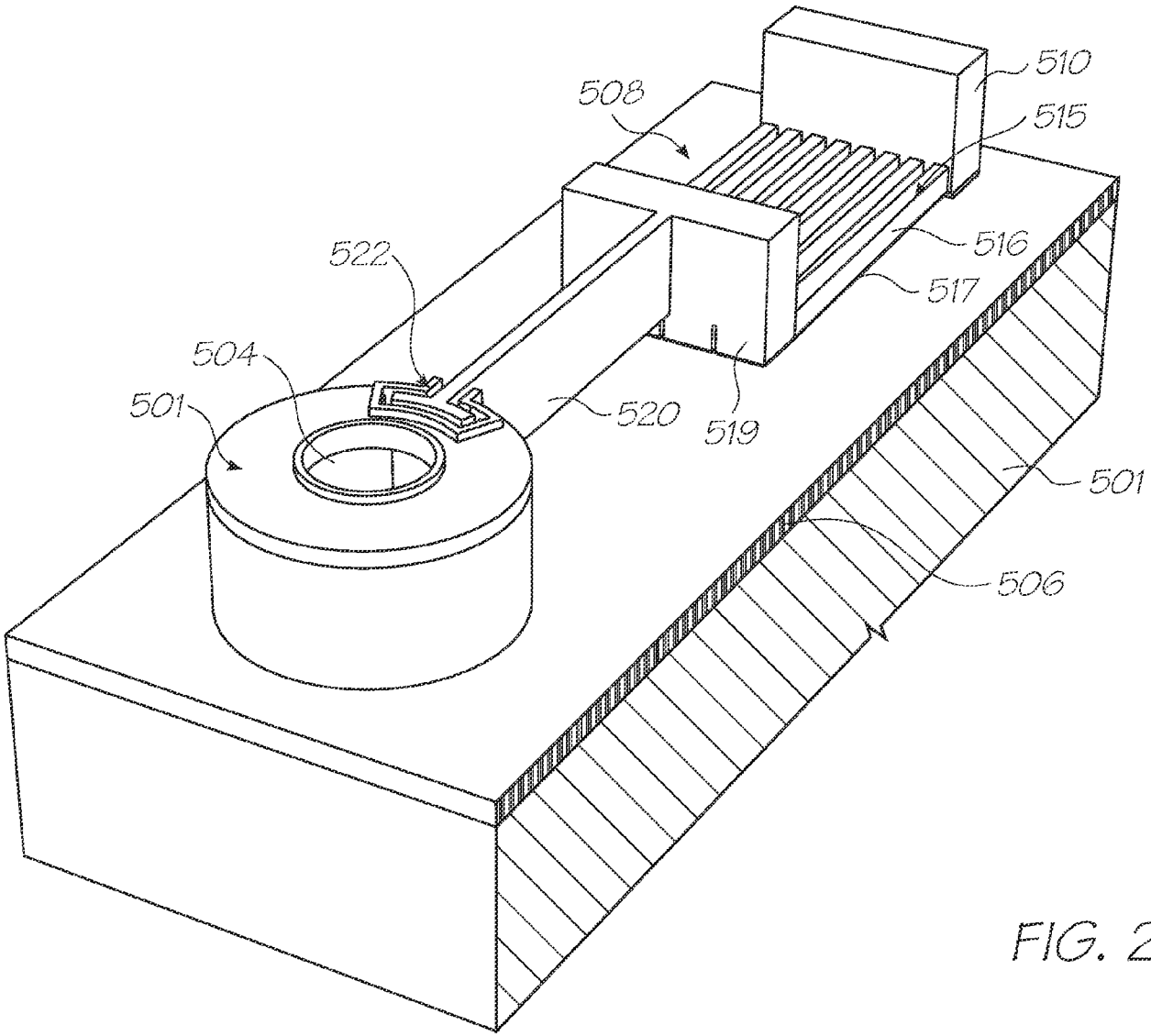
FIG. 20 shows a three dimensional view of a single ink jet nozzle arrangement constructed in accordance with FIG. 19.
Figure 21:
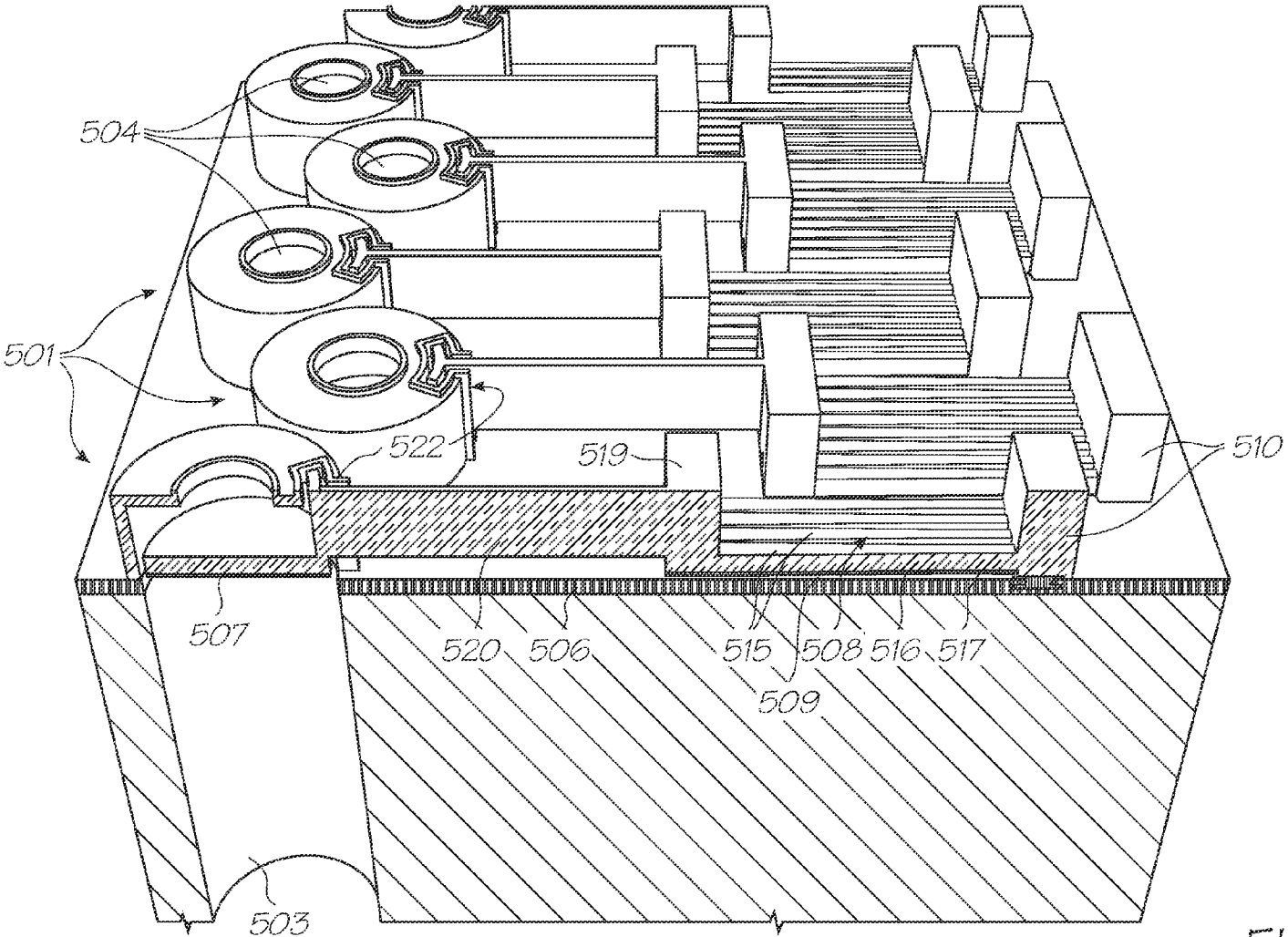
FIG. 21 shows an array of the nozzle arrangements shown in FIG. 20.

FIG. 20 illustrates a side perspective view of the nozzle arrangement. FIG. 21 illustrates sectional view through an array of nozzle arrangement of FIG. 20. In these figures, the numbering of elements previously introduced has been retained.

Firstly, the actuator 508 includes a series of tapered actuator units e.g. 515 which comprise an upper glass portion (amorphous silicon dioxide) 516 formed on top of a titanium nitride layer 517. Alternatively a copper nickel alloy layer (hereinafter called cupronickel) can be utilized which will have a higher bend efficiency.

The titanium nitride layer 517 is in a tapered form and, as such, resistive heating takes place near an end portion of the post 510. Adjacent titanium nitride/glass portions 515 are interconnected at a block portion 519 which also provides a mechanical structural support for the actuator 508.

The heater means 509 ideally includes a plurality of the tapered actuator unit 515 which are elongate and spaced apart such that, upon heating, the bending force exhibited along the axis of the actuator 508 is maximized. Slots are defined between adjacent tapered units 515 and allow for slight differential operation of each actuator 508 with respect to adjacent actuators 508.

The block portion 519 is interconnected to an arm 520. The arm 520 is in turn connected to the paddle 507 inside the nozzle chamber 501 by means of a slot e.g. 522 formed in the side of the nozzle chamber 501. The slot 522 is designed generally to mate with the surfaces of the arm 520 so as to minimize opportunities for the outflow of ink around the arm 520. The ink is held generally within the nozzle chamber 501 via surface tension effects around the slot 522.

When it is desired to actuate the arm 520, a conductive current is passed through the titanium nitride layer 517 within the block portion 519 connecting to a lower CMOS layer 506 which provides the necessary power and control circuitry for the nozzle arrangement. The conductive current results in heating of the nitride layer 517 adjacent to the post 510 which results in a general upward bending of the arm 20 and consequential ejection of ink out of the nozzle 504. The ejected drop is printed on a page in the usual manner for an inkjet printer as previously described.

An array of nozzle arrangements can be formed so as to create a single printhead. For example, in FIG. 21 there is illustrated a partly sectioned various array view which comprises multiple ink ejection nozzle arrangements laid out in interleaved lines so as to form a printhead array. Of course, different types of arrays can be formulated including full color arrays etc.

The construction of the printhead system described can proceed utilizing standard MEMS techniques through suitable modification of the steps as set out in U.S. Pat. No. 6,243,113 entitled "Image Creation Method and Apparatus (IJ 41)" to the present applicant, the contents of which are fully incorporated by cross reference.

It will, of course, be appreciated that a specific embodiment of the present invention has been described purely by way of example, and that modifications of detail may be made within the scope of the invention, which is defined by the accompanying claims.

The invention claimed is:

1. A printhead comprising:

an ejection surface having a plurality of nozzles for ejecting droplets; and a nozzle guard positioned over the ejection surface and having a plurality of channels therethrough aligned with the nozzles, wherein the channels have hydrophobic sidewalls and are radially flared with respect to the ink ejection surface such that droplets which are ejected from the nozzles with misdirection rebound off the channel sidewalls to pass through the channels.

2. A printhead according to claim 1, wherein the nozzles are configured so that the ejected droplets have sufficient surface energy to rebound off the channel sidewalls intact.

3. A printhead according to claim 1, wherein the channels are substantially parabolic in cross-section.

4. A printhead according to claim 1, wherein the rebounded droplets follow a trajectory substantially perpendicular to the ink ejection surface.

5. A printhead according to claim 1, wherein the nozzle guard is formed from a polymeric material.

6. A printhead according to claim 1, wherein the nozzle guard is formed from photoresist.

7. A printhead according to claim 6, wherein the photoresist is UV cured and/or hardbaked.

8. A printhead according to claim 1, wherein each channel has a length in the range of 10 to 200 microns.

9. A printhead according to claim 1, configured as a page-width printhead.

10. A printhead according to claim 1, wherein the printhead has a nozzle density sufficient to print images at up to 1600 dpi.

* * * * *